US006330860B1

(12) United States Patent
Kang

(10) Patent No.: US 6,330,860 B1
(45) Date of Patent: Dec. 18, 2001

(54) METHOD OF BLASTING USING AIR TUBES CHARGED IN A BLASTHOLE

(76) Inventor: Dae Woo Kang, Shingaegum LG Apt. 216-1702, 455 Gaegum-dong, Busanjin-gu, Busan 614-751 (KR)

( * ) Notice: Subject to any disclaimer, the term of this patent is extended or adjusted under 35 U.S.C. 154(b) by 0 days.

(21) Appl. No.: 09/512,192

(22) Filed: Feb. 24, 2000

(30) Foreign Application Priority Data

Sep. 16, 1999 (KR) ..... 1999-39907

(51) Int. Cl.[7] ..... F42B 3/00

(52) U.S. Cl. ..... 102/313; 102/312; 102/324; 102/333

(58) Field of Search ..... 102/312, 313, 102/324, 333

(56) References Cited

U.S. PATENT DOCUMENTS

| | | | | |
|---|---|---|---|---|
| 2,703,528 | * | 3/1955 | Lee et al. | 102/313 |
| 2,858,764 | * | 11/1958 | Hesson et al. | 102/312 |
| 4,419,935 | * | 12/1983 | Shibukawa | 102/312 X |
| 4,438,699 | * | 3/1984 | Nitzberg | 102/312 X |
| 4,813,358 | * | 3/1989 | Roberts | 102/313 |
| 4,919,203 | * | 4/1990 | Fitzgibbon, Jr. | 102/333 X |
| 5,000,261 | * | 3/1991 | Fitzgibbon, Jr. | 102/333 X |
| 5,273,110 | * | 12/1993 | Fitzgibbon, Jr. | 102/333 X |
| 5,841,060 | * | 11/1998 | Skaggs | 102/333 |

OTHER PUBLICATIONS

"Numberical Modelling of the Effects of Air Decking/Decoupling in Production and Controlled Blasting" by Liu et al., *Rock Fragmentation by Blasting,* Mohanty (Ed.) ISBN 90 5410 824X, pp. 319–330.

"Ground Vibration from Single–Hole Cast Blasts" by Yang et al., *The Journal of Explosives Engineering,* Mar./Apr. 1999, pp. 37–41.

Advertisement for Vari–Stem of St. Louis, Missouri for "Greater Rock Fragmentation, Less Cost", *The Journal of Explosives Engineering,* Jul./Aug. 1999, p. 22.

* cited by examiner

*Primary Examiner*—Peter A. Nelson
(74) *Attorney, Agent, or Firm*—Sheridan Ross P.C.

(57) ABSTRACT

A rock blasting method is provided in which a series of aligned boreholes are charged with explosives and air tubes in a predetermined pattern. The air tube is a cylindrical flexible tube having a predetermined width and length to be fitted with the borehole. In one preferred form, each borehole is charged with the explosives and detonator with one air tube installed above the explosives. Stemming materials are installed above the air tube. For example, in a 45-millimeter diameter and 2.5-meter long borehole, the length of explosive charging is 0.8 meters, the co-operating charge weight was 0.648 Kg, the total amount of explosive 3.24 Kg, the length of the air tube 1.0 meter, the diameter of air tube 40 millimeters, and the length of stemming 0.7 meters. The explosives and air tube may be alternately charged along the borehole. The use of air tubes, charged above at least one explosive layer allows a quantitative air decking in every blasthole. A reduction in detonation velocity and noise is observed in the field test. Also, the air-deck effect can be easily obtained: an increase in fragmentation rate with minimizing the production of boulders. A reduction in explosive usage is also achieved.

15 Claims, 20 Drawing Sheets

METHOD OF BLASTING USING AIR TUBES CHARGED IN A BLASTHOLE

FIELD OF THE INVENTION

The present invention relates to blasting with explosives, and more particularly to a rock blasting method for reducing ground vibration and noise of the blast in which an air tube is charged with explosives in a borehole.

BACKGROUND OF THE INVENTION

Heretofore, rock blasting for reducing ground vibration has been undertaken by employing various methods known as deck charge, air-decking, pre-splitting and so forth. In the deck charge, explosive cartridges and stemmings are alternately charged along the borehole. Each explosive charge in the borehole is provided with a detonator and the explosives are detonated by delay blasting to reduce ground vibration. This method is costly since it requires a large number of detonators in order to be fitted with the charged explosives. Further, this method is less effective in reducing ground vibration since the same amount of explosives must be used in each charge layer.

In the air-decking method, explosive and detonator are charged at the lower part of the borehole to leave space above the explosive charge, and a plug is used to retain the stemming material at the borehole collar. The space between the top of the explosive charge and the bottom of the plug is the air deck used in blasting. The air deck space is rapidly occupied by the detonation products. The detonation products move repeatedly in the chamber, impacting the borehole wall until an equilibrium state in pressure is reached. A significant amount of potential energy retained in the detonation products is released and imparted to the rock mass, which forms a secondary loading wave in addition to the primary loading wave generated by the detonation of the explosive charge. When the air deck is longer than a predetermined length, the volume of the fragmented rock mass is increased. In addition, the average fragment size gets smaller and the size distribution becomes more uniform. Numerical modeling of the effects of air decking is described in the article of Liqing Liu and P. D. Katsabanis in journal *Rock Fragmentation* by blasting, Mohanty (ed.) 1996 Balkema, Rotterdam, pp.319–330.

In addition, there is indication that the air-decking may reduce ground vibration from ANFO shots to a certain degree. In a field experiment from an article "Ground Vibration from Single-hole Cast Blasts" of Xiaoning Yang, Brian W. Stump and John D. Smith, *The journal of Explosives Engineering*, March/April 1999, pp. 36–41, slightly reduced ground vibration level (15%) from air-decked shot loaded with ANFO was reported.

However, when the air-decking is adopted in the open large scale blast site, positioning the plug in every borehole at a uniform depth is difficult since the plug is plastic and apt to be moving in the borehole. This results in different length of the air deck in each borehole, thereby degrading the above-mentioned air deck effect. Further, it is difficult to secure constant quantity of air in every air deck since the borehole diameter becomes narrow as drilling bits wear out by use. This also affects the air deck effect.

Another method of producing substantially reduced vibration involves arranging explosive cartridges in a borehole such that they are connected serially by a detonating fuse at spaced intervals to form air space between charged explosives. This method, commonly referred to as pre-splitting, requires use of a large amount of explosive which, upon detonation, produce considerable noise of the blast.

Therefore, the above-mentioned prior art blasting methods have problems in that they are still ineffective either in obtaining quantitative air decking or reducing ground vibration and noise of the blast.

SUMMARY OF THE INVENTION

The present invention provides an improved rock blasting method which method comprises drilling a series of aligned boreholes in a rock body according to a desired drilling pattern; charging the boreholes with explosives and an air tube in a predetermined pattern so as to provide a quantitative air decking in every charged borehole; and detonating the charged boreholes with stemmings on the top of the explosive or air tube.

The air tube is a cylindrical flexible tube having a predetermined width and length to be fitted with the borehole. An air injection port is provided at one end portion of the air tube. The air tube is made in the form of sheets and the diameter thereof, upon inflated, becomes the same as or smaller than that of the boreholes. The air tube and air injection port are made from synthetic materials such as polyethylene, polypropylene, polyester and polyamide.

Preferably, the air tube is inflated by using an air injector of air compressors provided in work sites. In the arrangement, the explosives and air tube are alternately charged along the borehole. Further, the air tube is charged first at the bottom of the borehole and subsequently a detonator is charged above the air tube. A plug may be installed above the top of the air tube charged in the borehole. Furthermore, the explosives and air tube are charged in adjacent two boreholes such that they are located in cross relation between each other so that one air tube may face lateral explosives in adjacent boreholes.

The air tube installed above the top of explosives reduces the length of stemmings charged above the air tube as much as the extent of the air tube. The explosives charged above the air tube is detonated by sympathetic detonation.

BRIEF DESCRIPTION OF THE DRAWINGS

This invention may be understood and its features and advantages will become apparent to those skilled in the art by reference to the accompanying drawings in which;

FIGS. 3A and 3B are perspectives of the air tube used in this invention, in which FIG. 3A shows the air tube in the form of sheet and FIG. 3B the inflated state of the air tube;

DETAILED DESCRIPTION OF PREFERRED EMBODIMENTS

Figure 1A:
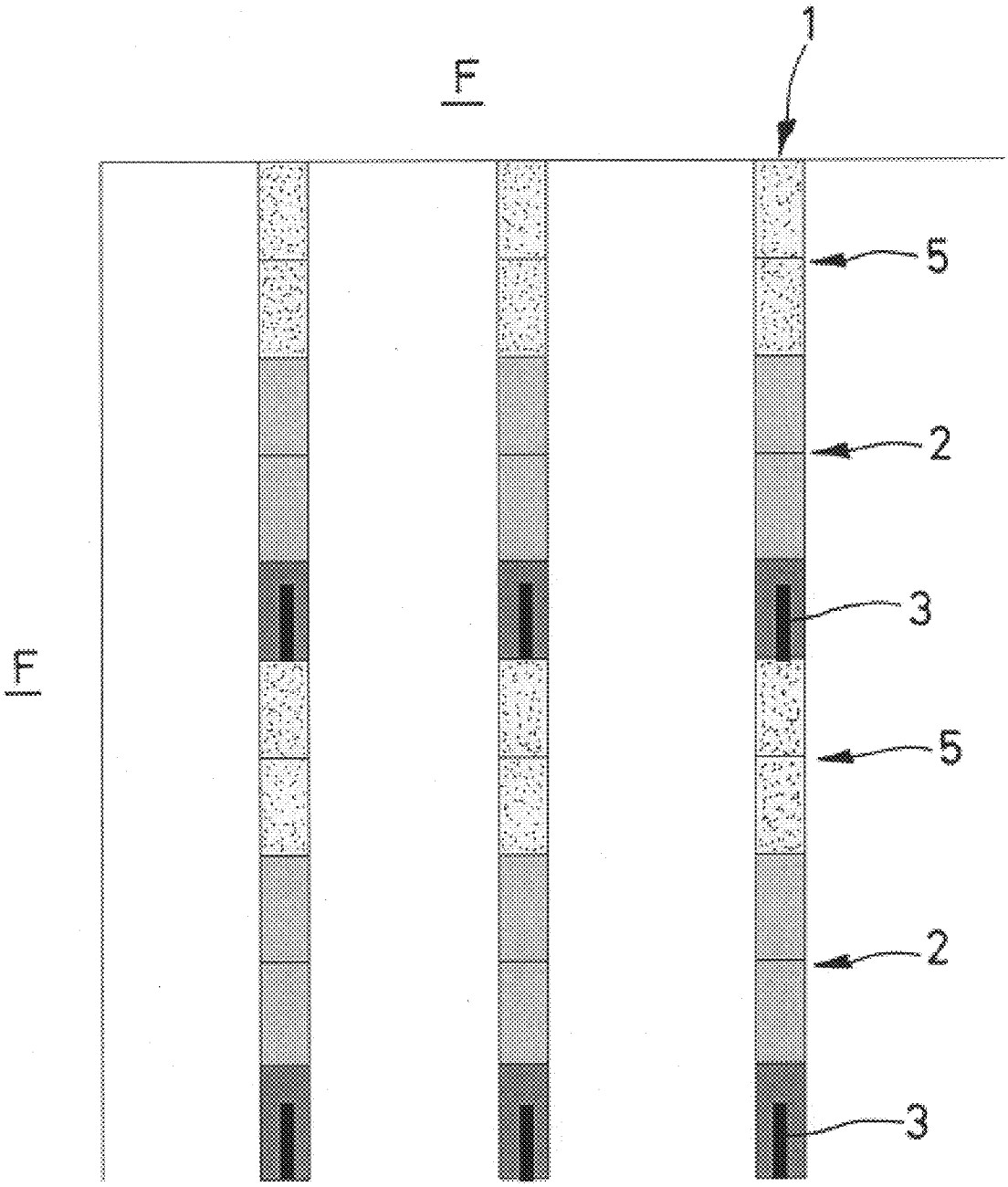
FIG. 1A (Prior art)
FIG. 1A is a vertical cross section of charged boreholes according to prior art deck charge blast method.

In the prior art deck charge blast method shown in FIG. 1A, for example, a series of boreholes 1 are drilled downward and in alignment into the rock body which is desired to be cracked or sheared along a line. The boreholes 1 are customarily drilled vertically in space and parallel to the slope of the hill, and drilled to the depth required for the new contour. After drilling, the boreholes 1 are charged with explosives 2 and stemming material 5 alternately to form two layers of explosive. Each explosive layer 2 is charged with detonator 3 and the charged borehole is detonated by delay blasting. In the drawing, "F" denotes free surfaces. While generally successful in reducing vibration of blasting, the deck charge method requires a large number of detonators to be fitted with the charged explosives. Further, if the same amount of explosive is used in every explosive charge, the effect of reducing vibration is lessened.

Figure 1B:
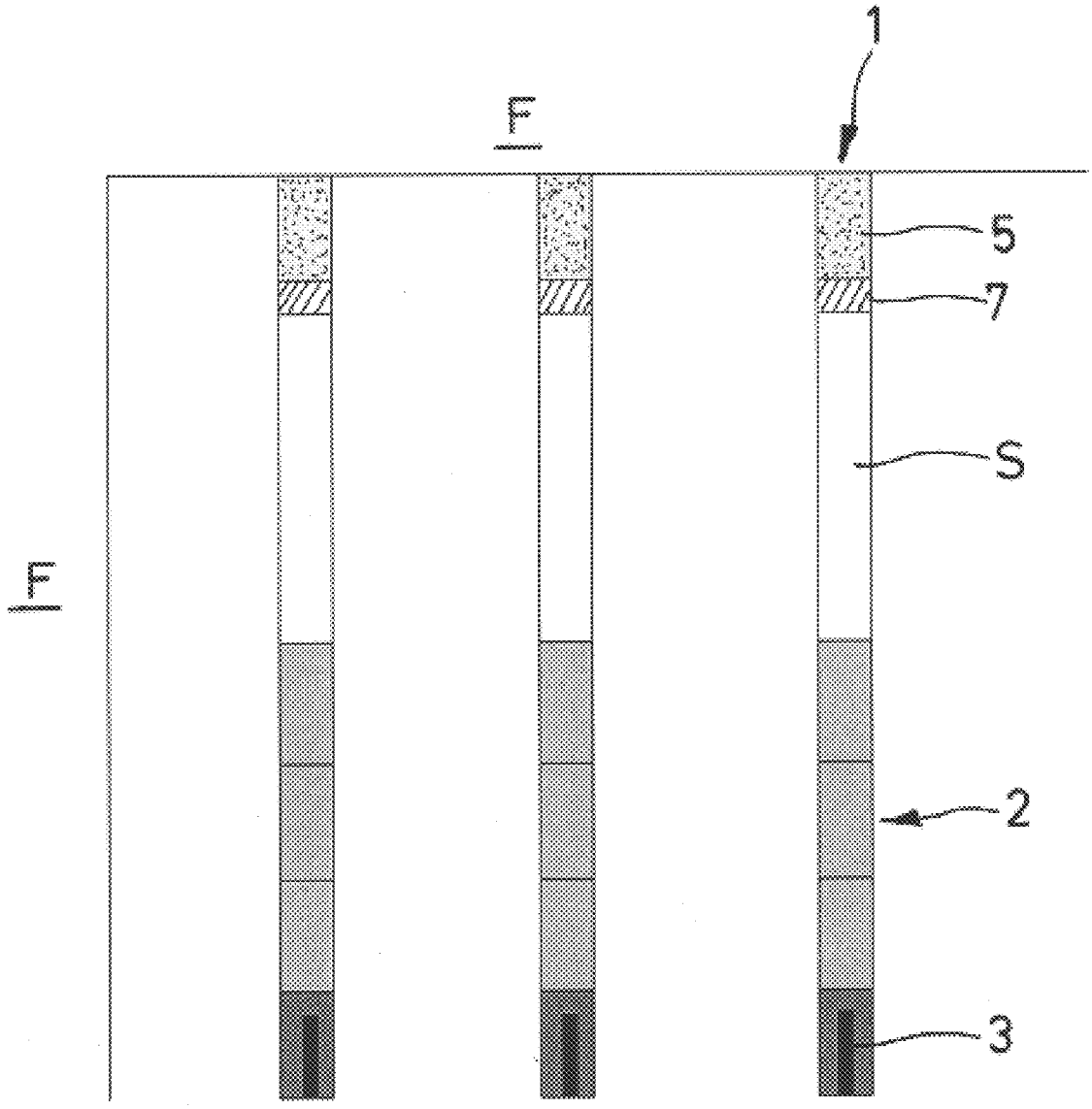
FIG. 1B (Prior art)
FIG. 1B is a vertical cross section of charged boreholes according to prior art air-decked blast method.

As to common air-deck blast method shown in FIG. 1B, explosive 2 and detonator 3 are charged at the lower part of the borehole 1 to leave space S above the explosive charge 2, and a plug 7 is used to retain the stemming material 5 at the borehole collar. The space S between the top of the explosive charge 2 and the bottom of the plug 7 forms the air deck in blasting. If the air deck is longer than a predetermined length, the air-deck effect would come out: the volume of the fragmented rock mass increases, the average fragment size gets smaller, the size distribution becomes more uniform and the diggability of the damage zone is improved. Additionally, the air-decking may reduce the ground vibration from ANFO shots to a certain degree. It is known in the art that ground vibration level is slightly reduced (15% amplitude) from air-decked shot loaded with ANFO. Also known is that the ground vibration level is primarily correlated with charge weight, which is proportional to explosive density.

This prior art air decking method has problems in that aligning the plug in every borehole is much laborious and securing constant quantity of air in the air deck is difficult since the quantity of air may vary with positioning of the plug and variation of the borehole diameter due to wear of drilling bits.

Figure 1C:
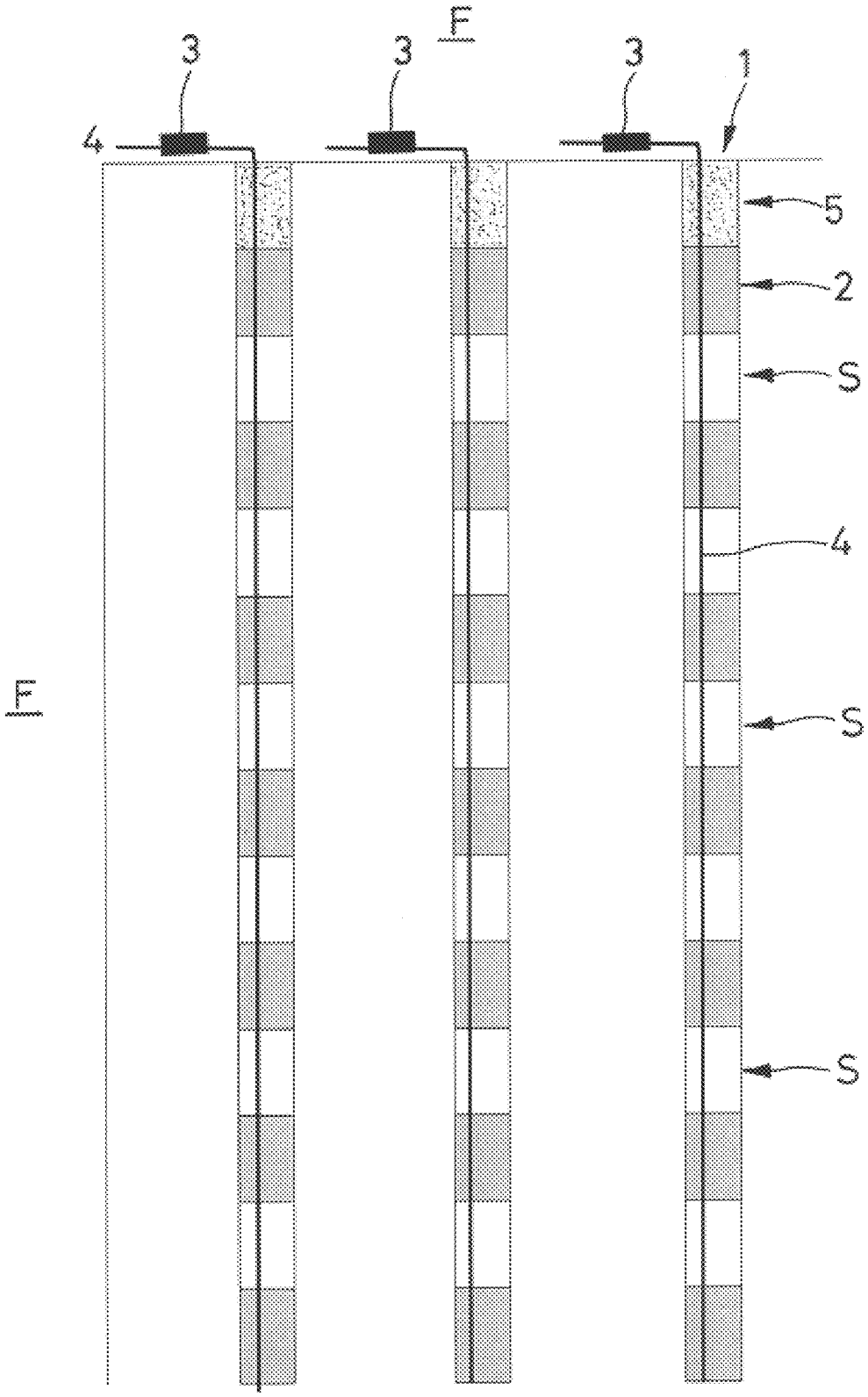
FIG. 1C (Prior art)
FIG. 1C is a vertical cross section of charged boreholes according to prior art pre-splitting method.

In the pre-splitting blast with air decking shown in FIG. 1C, for example, explosive cartridges 2 have been charged in a borehole 1 such that they are connected serially by a detonating fuse 4 at spaced intervals to form spacing S between charged explosives 2. This method requires use of a large amount of explosive which, upon detonation, produce considerable noise of the blast.

Figure 2A:
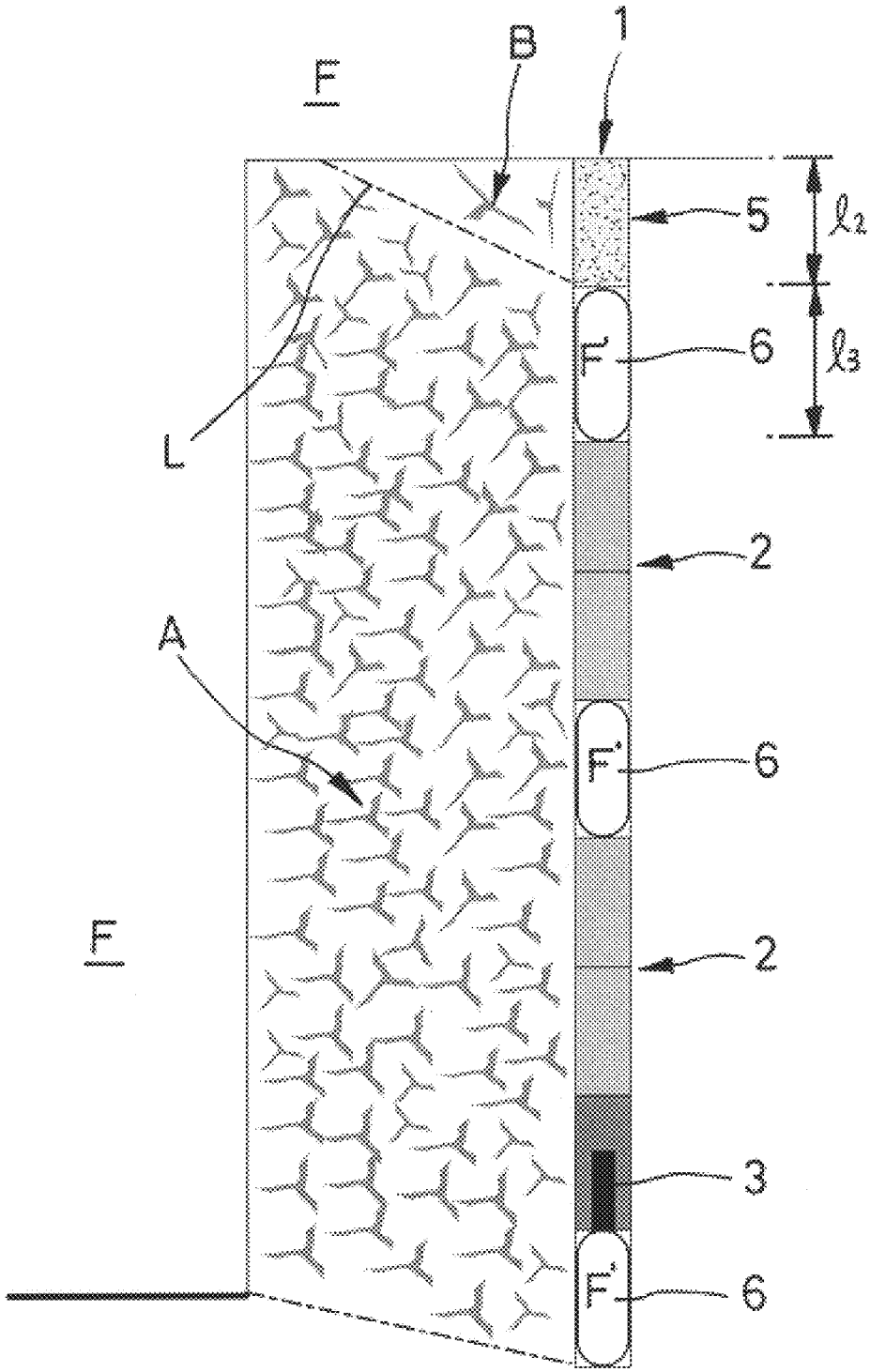
FIGS. 2A and 2B illustrate basic concept of the blasting method using an air tube in accordance with the present invention.
Figure 2B:
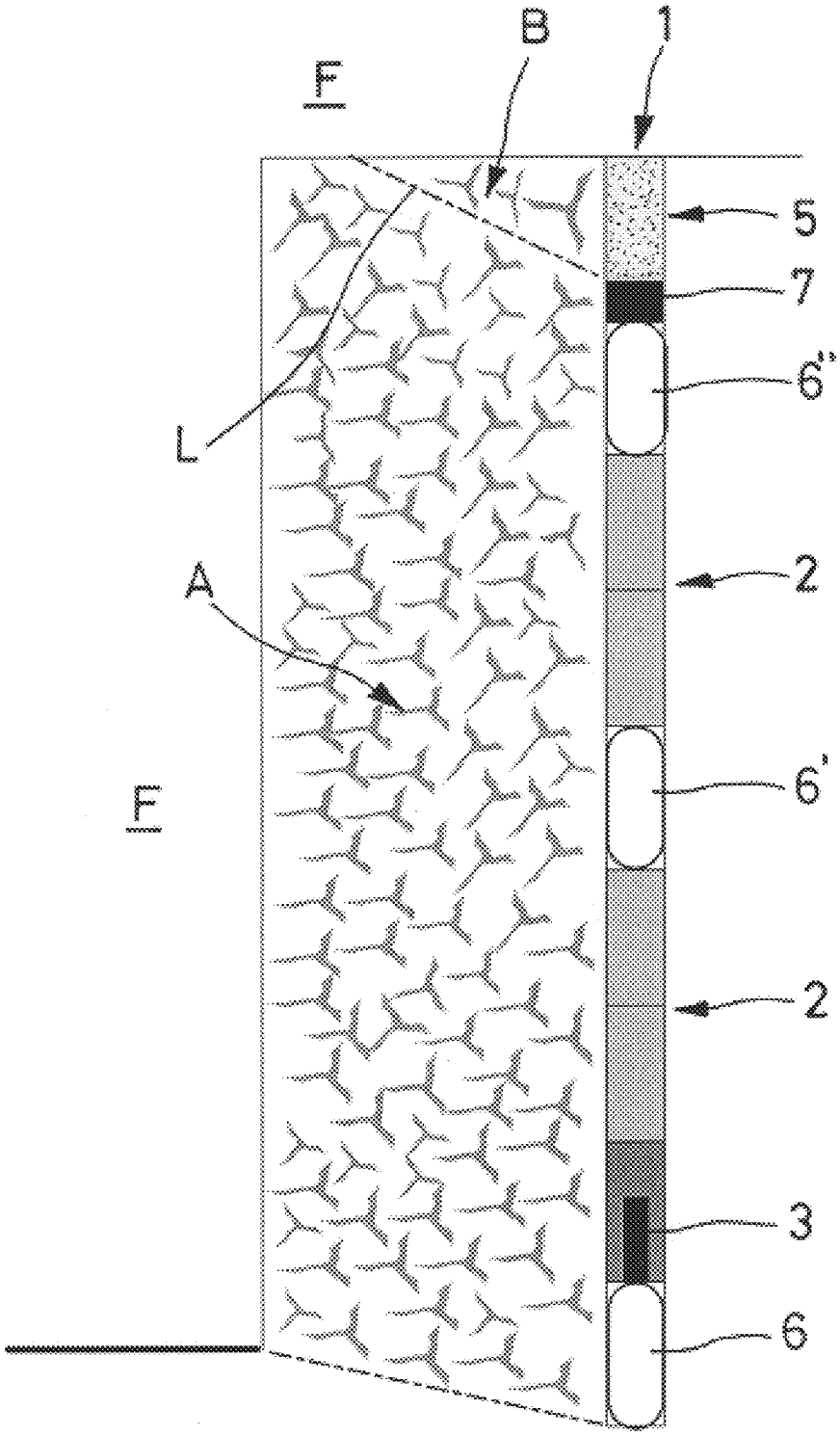
Figure 3A:
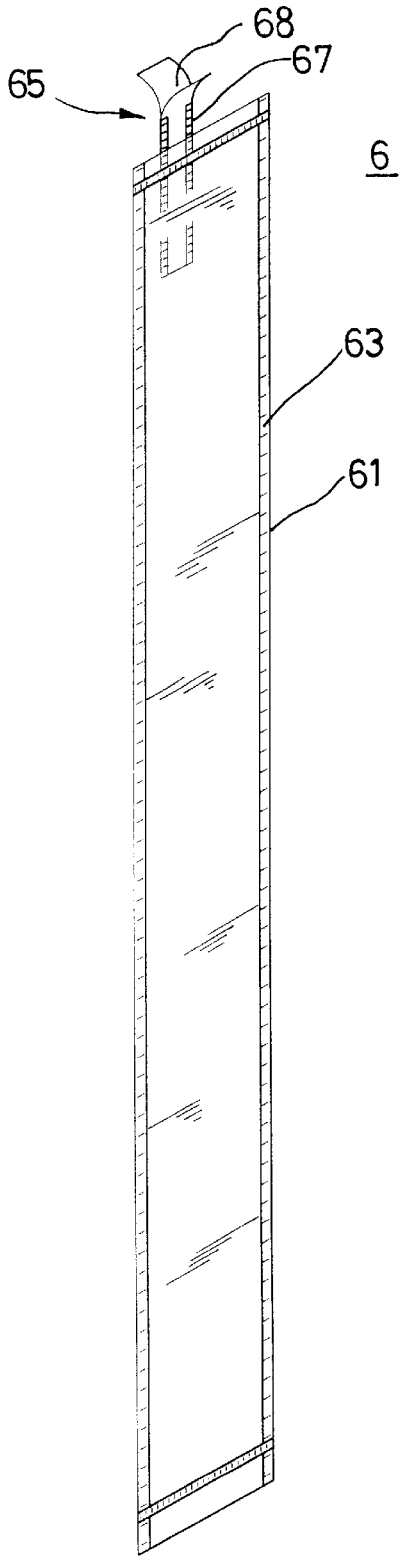
Figure 3B:
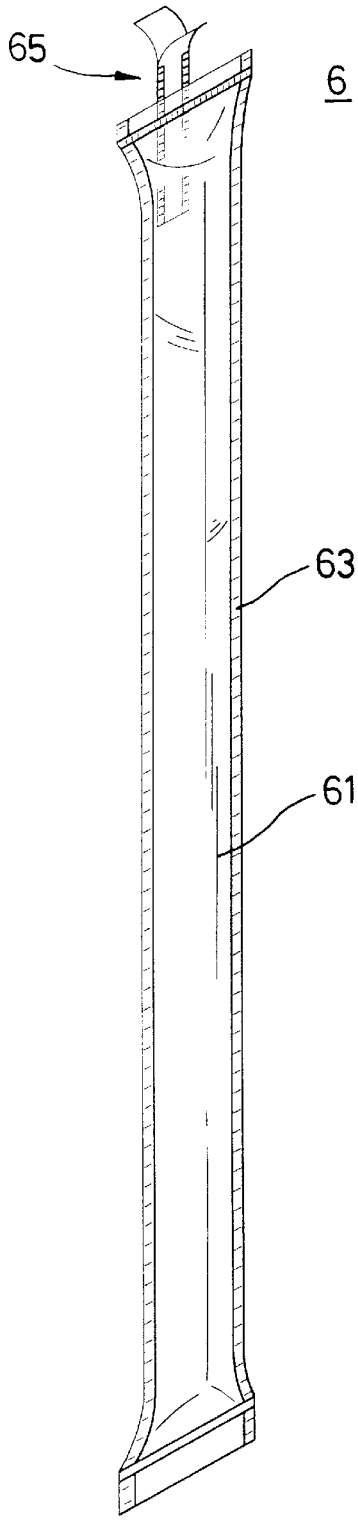

In the method of the present invention as shown in FIGS. 2A and 2B, basically, boreholes are charged with explosives 2 with an air tube 6 inserted above or below the explosives 2. A detonator 3 is installed at the bottom of the borehole 1. Preferably, the air tube 6 may be installed first at the bottom portion of the borehole. In addition, the explosives 2 may be charged in layers with the air tubes 6 interposed between two explosives. Stemming materials 5 are installed above the top air tube 6. Further, as shown in FIG. 3B, a rubber plug 7 may be installed above the top air tube 6, that is between the stemming materials 5 and the top of the air tube 6.

The air tube 6 is a cylindrical flexible tube made from synthetic materials such as polyethylene, polypropylene, polyester and polyamide. As shown in FIG. 3A, the air tube 6 is formed in sheets to have a predetermined width and length with two sheets of tube body 61 seamed together at the periphery thereof. Reference number 63 denotes the seam portion. The air tube 6 includes an elongated air injection port 65 provided at one end portion of the tube body 61. The air injection port 65 is also a sheet article made from synthetic materials and this article is commercially available in the market. The air injection port 65 has seam portion 67 formed along each longitudinal side of the port 65 to provide an air inlet 68. This air injection port 65 is inserted between two sheets of tube body 61 and incorporated into the air tube 6 at final thermal seaming process.

The air tube 6 can be inflated in a simple and easy manner by using an injector of air compressors in the work site. Inserting an air gun or injector nozzle of air compressors into the air inlet 68 of the air tube 6 allows the inflation of the air tube.

The diameter of the air tube 6, upon inflated, became the same as or smaller than that of boreholes so that the inflated air tube can be easily inserted into the borehole. When the air tube 6 is inserted, the outer wall of the air tube 6 adheres closely to the inner wall of the borehole by the load of the explosives and stemming materials charged above the air tube 6.

The air tube 6 charged in a borehole allows formation of at least one artificial free surface F' below or above the explosives 2. These small free surfaces F' in the charged borehole produce the air decking/decoupling in production blasting as well as sympathetic detonation of the deck charged explosives. Also, the air tube 6 charged in boreholes allows a quantitative air decking in each blasthole.

When the explosives 2 are detonated, the vibration of blasting is dispersed toward the free surface F' formed by air tube 6 and this slows down the detonation velocity, thereby lessening ground vibration of the blast.

Further, upon detonation, the air tube 6 increases the total pressure of the explosive charged in the borehole and expands the specific surface area of the rock maximizing projection area of the explosion toward free surfaces of the rock. This allows a rise of the fracture boundary line L to the extent of the length $l_3$ of the air tube 6 and expansion of fragmentation region A toward the upper face of the rock. Thus, fragmentation rate or breakage of the rock is increased.

Additionally, when the air tube 6 is charged above the explosives 2, the length of the stemmings 5 can be shortened as much as the length $l_3$ of the air tube 6, thereby reducing production of boulders B in blasting of rock.

Similar to the deck charge method, the air tube 6 can be charged between explosive cartridges 2 instead of stemming material. In this case, eliminating the detonator charged at the upper side explosive cartridges is possible considering the sympathetic detonation. Generally, the sympathetic detonation is determined by the space between two explosives and the diameter of the explosives, and the coefficient of detonation transmission (n) can be normally expressed by n=S/d, in which S means maximum distance (mm) and d means diameters of the cartridges (mm). According to the established experiment, the coefficient of detonation transmission (n) is known to be about 2.5 in the air gap between normal explosive cartridges.

However, in a field example, when 32 mm–50 mm diameter cartridges are used in the borehole of 45 mm–165 mm diameters, the maximum distance was increased beyond 500 mm. In this case, the coefficient of detonation transmission (n) becomes 10–16. Thus, practical length $l_3$ of the air tube 6 may range from 50 cm to 300 cm. Further, the co-operating charge weight used in this method may fall within the range from 0.100 kg to 2,000 kg.

The explosives 2 used in the method of this invention may be of any kind of explosive used in common blasting method. The explosive can be initiated by common blasting machines connected with ignition cables. The detonator may be of any delay detonators including a standard electric detonators and non-electric detonators with time delay function. Where the explosive and air tube are alternately charged, it is preferred that the delay time of delay detonator be selected to have wide range.

The diameter of the rubber plug 7 installed above the air tube 6 is determined to fit with a desired borehole. The rubber plug 7 may be of commercially available plugs named "VARI-STEM™." This rubber plug 7 may isolate the explosion noise to a certain degree, and thereby enhancing the noise covering effect in the present invention.

Figure 4A:
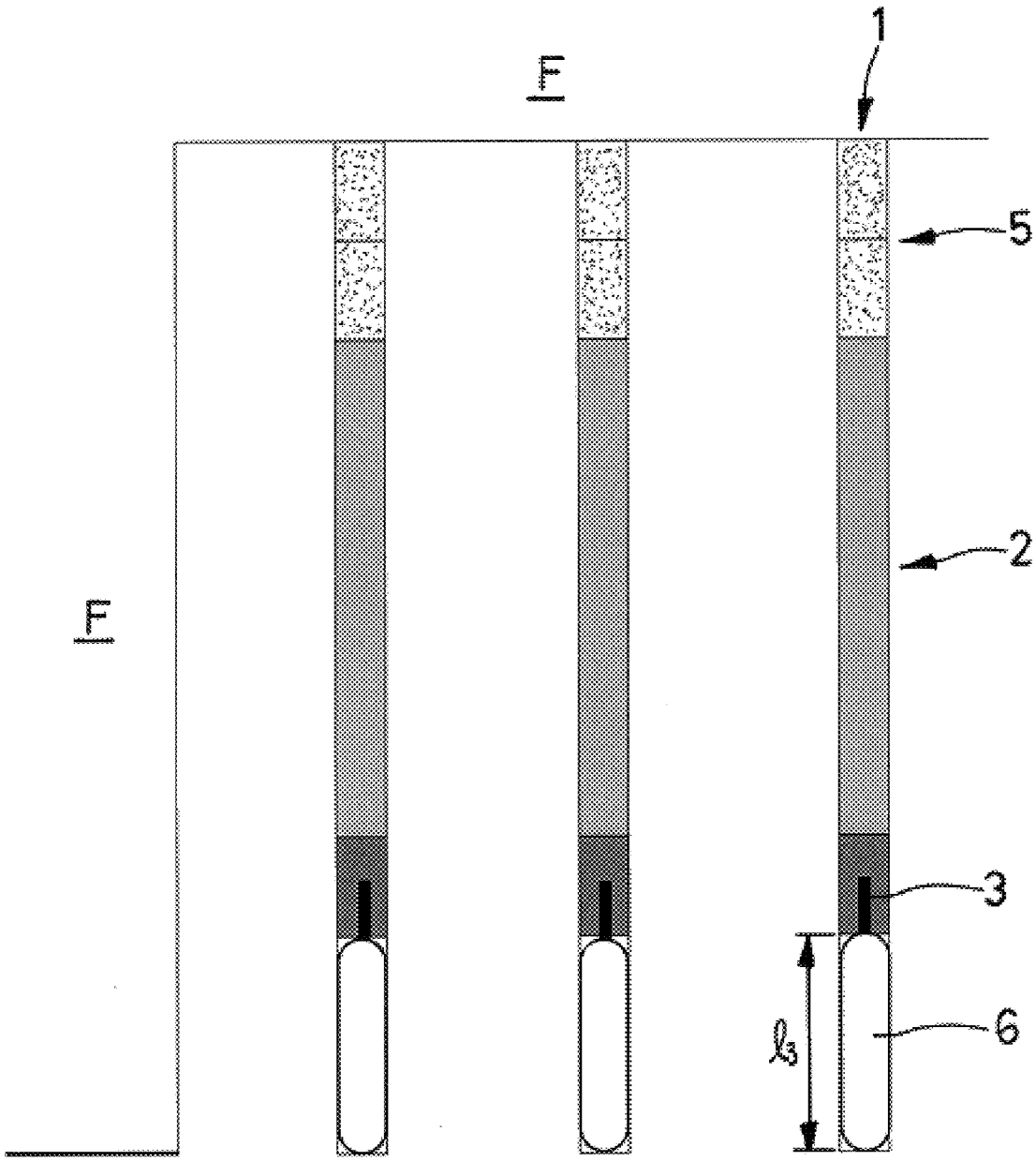
FIGS. 4A to 4H show various charge patterns of the air tube in a series of boreholes in accordance with embodiments of the present invention.

FIGS. 4A to 4H show various location of air tubes loaded in blastholes in accordance with embodiments of the present invention. The boreholes 1 are customarily drilled vertically in space and parallel to the slope of the hill, and drilled to the depth required for the new contour. In FIG. 4A, each borehole 1 is charged with the air tube 6 at the bottom of the borehole. Subsequently, the explosives 2 and detonator 3 are charged above the air tube 6. Finally, stemmings 5 are installed above the explosives 2.

Figure 4B:
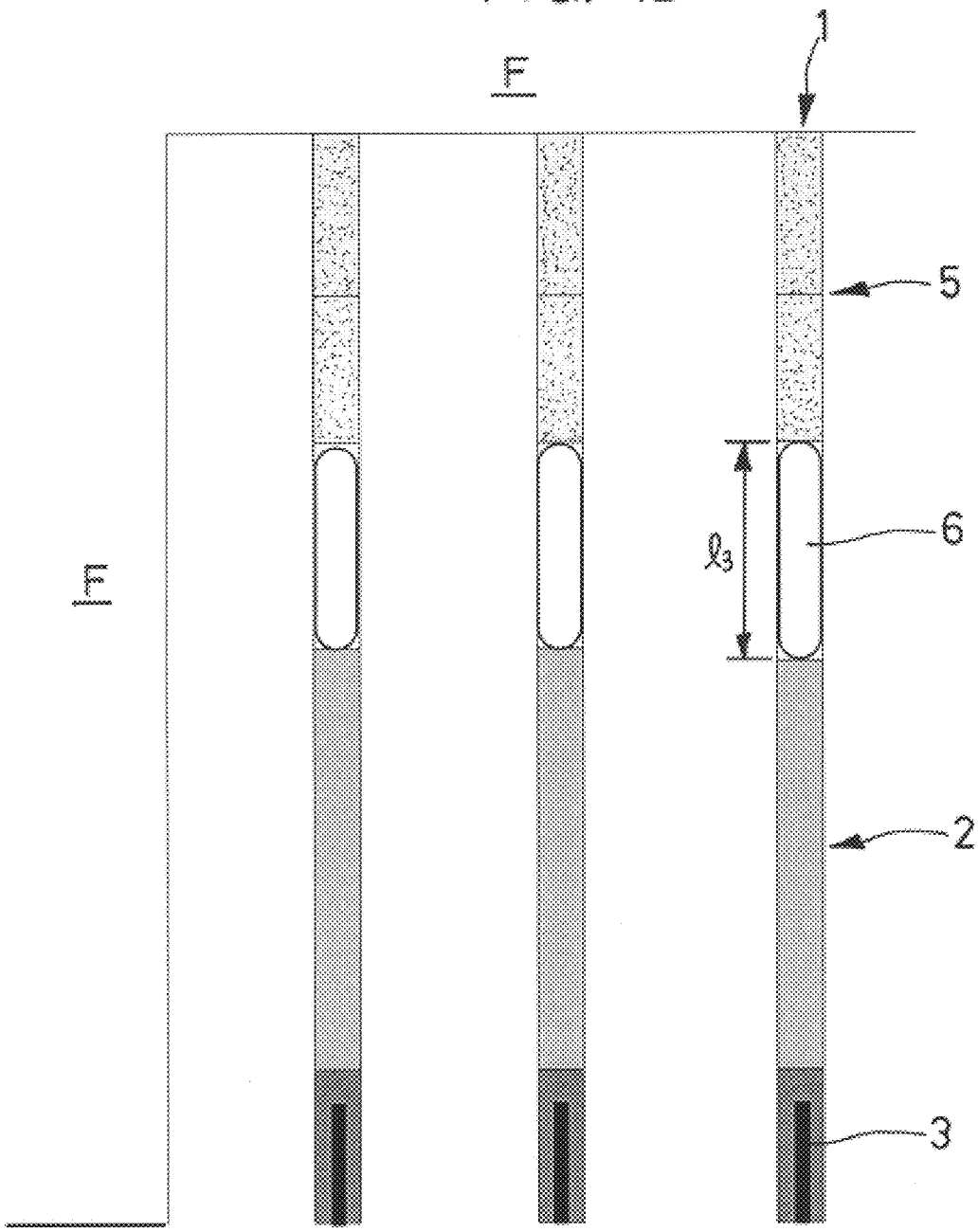

In FIG. 4B, boreholes 1 are charged first with the explosives 2 and detonator 3 at the bottom of the borehole. Subsequently, the air tubes 6 are charged above the top of the explosives 2 and then the stemmings 5 are installed above the air tube 3.

Figure 4C:
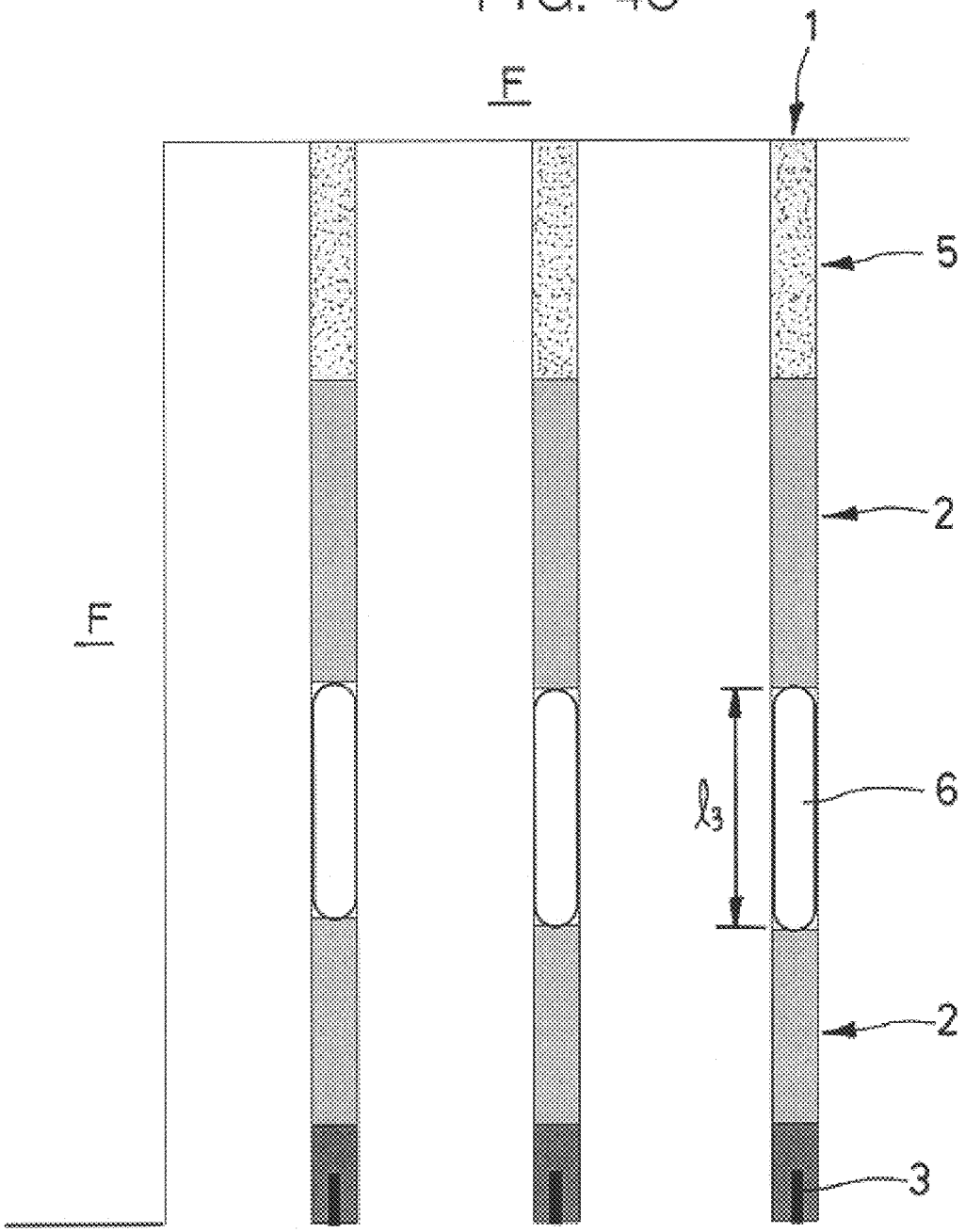

In FIG. 4C, boreholes 1 are charged with explosives 2 and detonator 3 at the bottom of the borehole. Subsequently, air tubes 6 are charged above the explosives 2 and then a further explosives 2 are charged above the air tube 6. The stemmings 5 are installed above the top explosives 2. Consequently, the air tubes 6 are charged between the bottom and top explosives 2 as similar to prior art deck charge method.

Figure 4D:
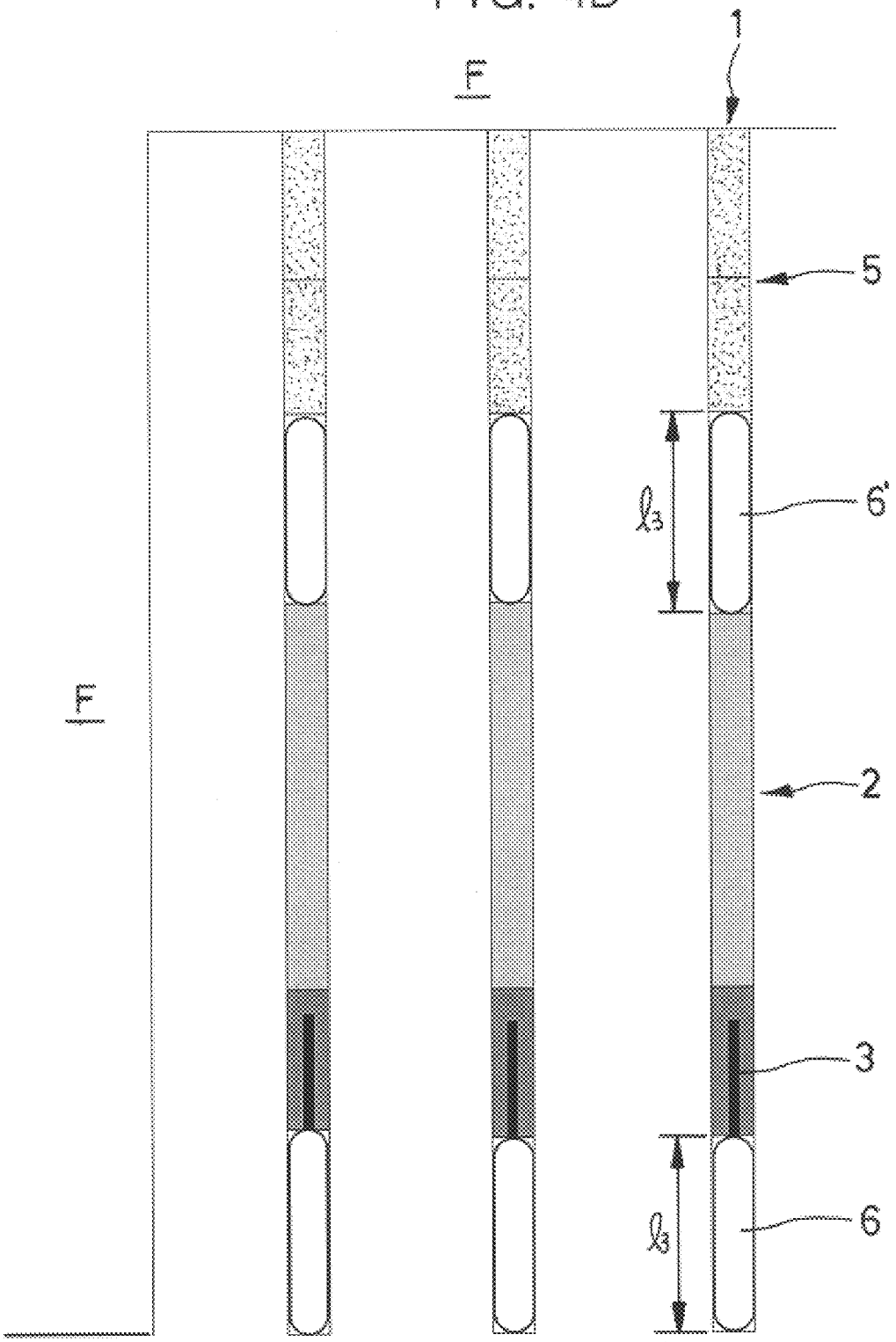

In FIG. 4D, boreholes 1 are charged first with air tubes 6 at the bottom of the borehole and subsequently the explosives 2 and detonator 3 are charged above the air tube 6. A second air tube 6' is charged above the explosives 2. Finally, stemmings 5 are installed above the second air tube 6'.

Figure 4E:
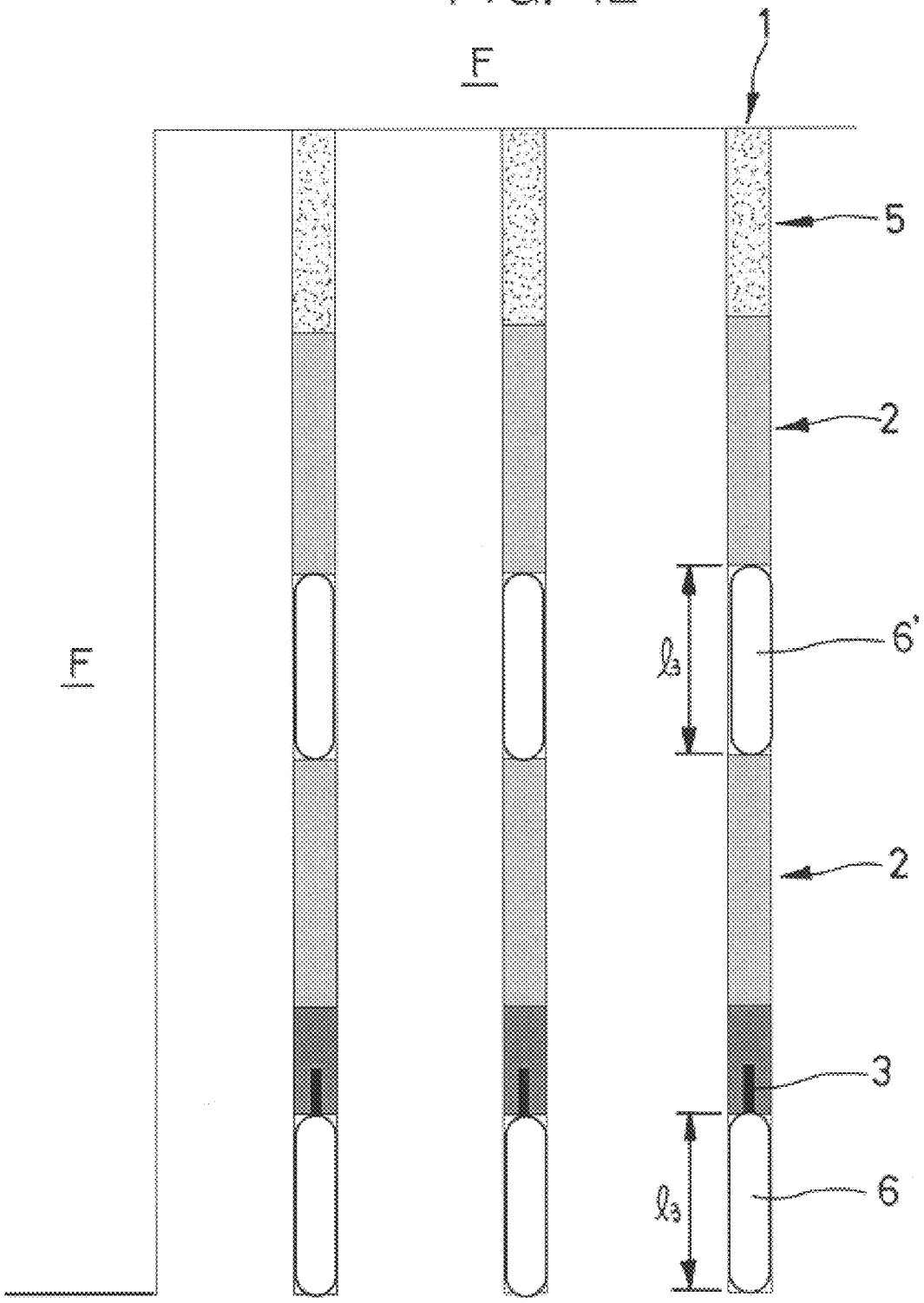

In FIG. 4E, boreholes 1 are charged with air tubes 6 at the bottom of the borehole and the explosives 2 and detonator 3 are charged above the air tube 6.

Subsequently, a second air tube 6' is charged above the explosives 2 and then a further explosives 2 is charged above the second air tube 6'. The stemmings 5 are installed above the top explosives 2. Consequently, the air tubes are charged at the bottom of the borehole and between two explosives layers 2.

Figure 4F:
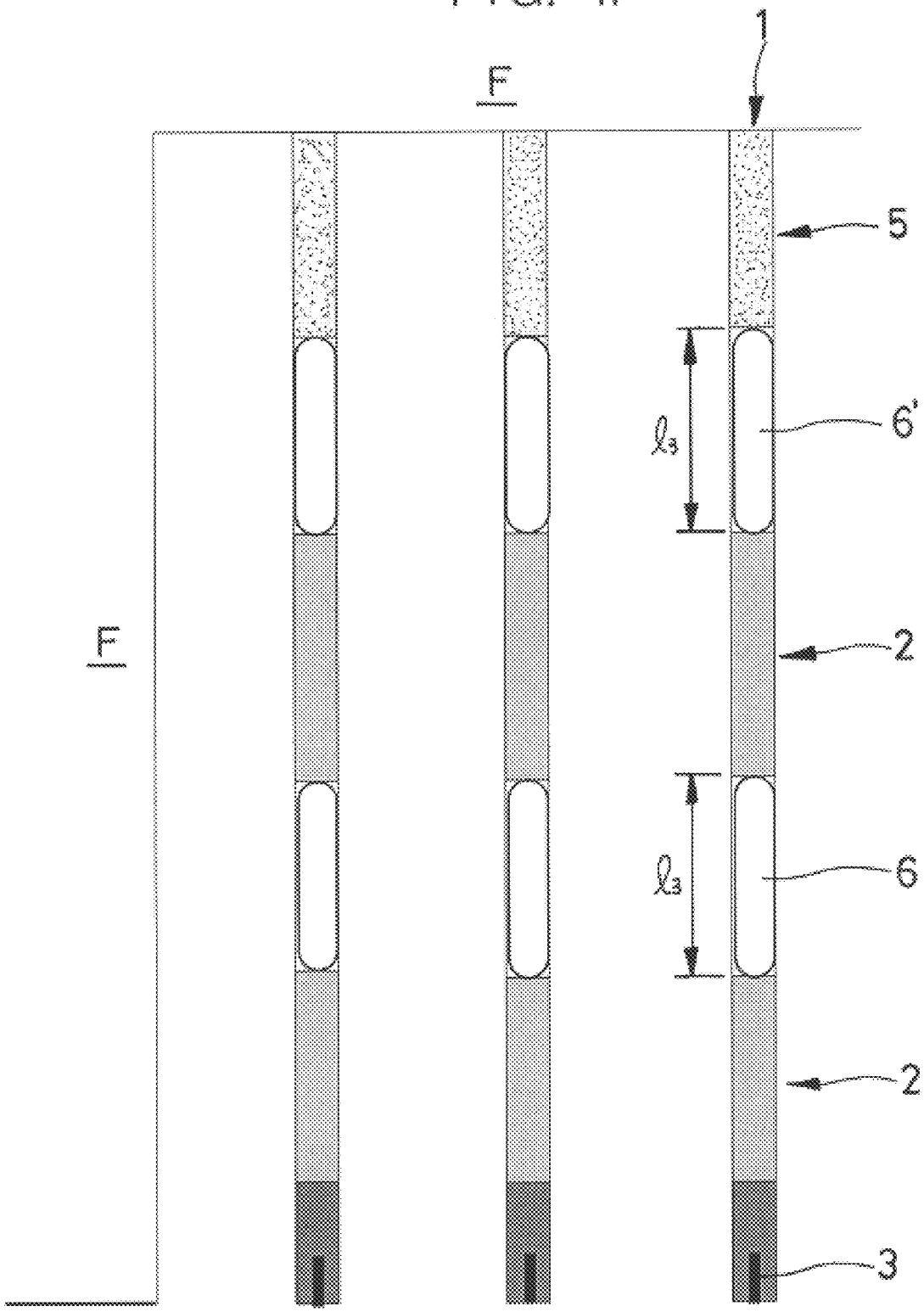

In FIG. 4F, boreholes 1 are charged with explosives 2 and detonator 3 at the bottom of the borehole. Subsequently, air tubes 6 are charged above the explosives 2 and then a second explosives 2 are charged above the air tube 6. Again, a second air tube 6' is charged above the second explosives 2 and then stemmings 5 above the second air tube 6'. Consequently, the air tubes are charged between the first and second explosive layers 2 and at the top of the second explosives 2.

Figure 4G:
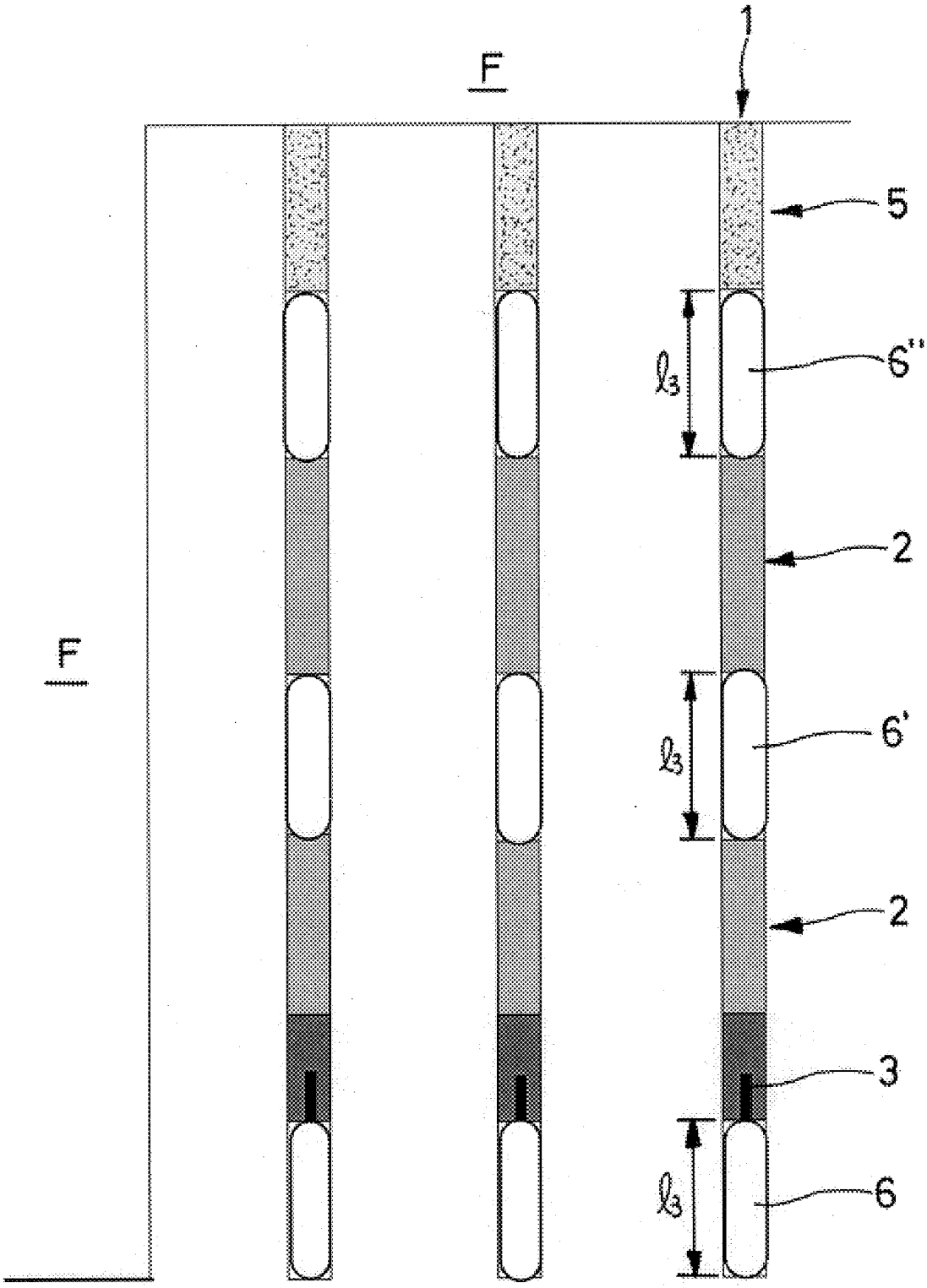

In FIG. 4G, boreholes 1 are charged with air tubes 6 at the bottom of the borehole and the explosives 2 and detonator 3 are charged above the air tube 6. Subsequently, a second air tube 6' is charged above the explosives 2 and then a second explosives 2 are charged above the second air tube 6'. Again, a third air tube 6" is charged above the second explosives 2 and then stemmings 5 are installed above the third air tube 6". Consequently, the air tubes are charged at the bottom of the borehole, between two explosives layers 2, and at the top of the second explosives 2.

Figure 4H:
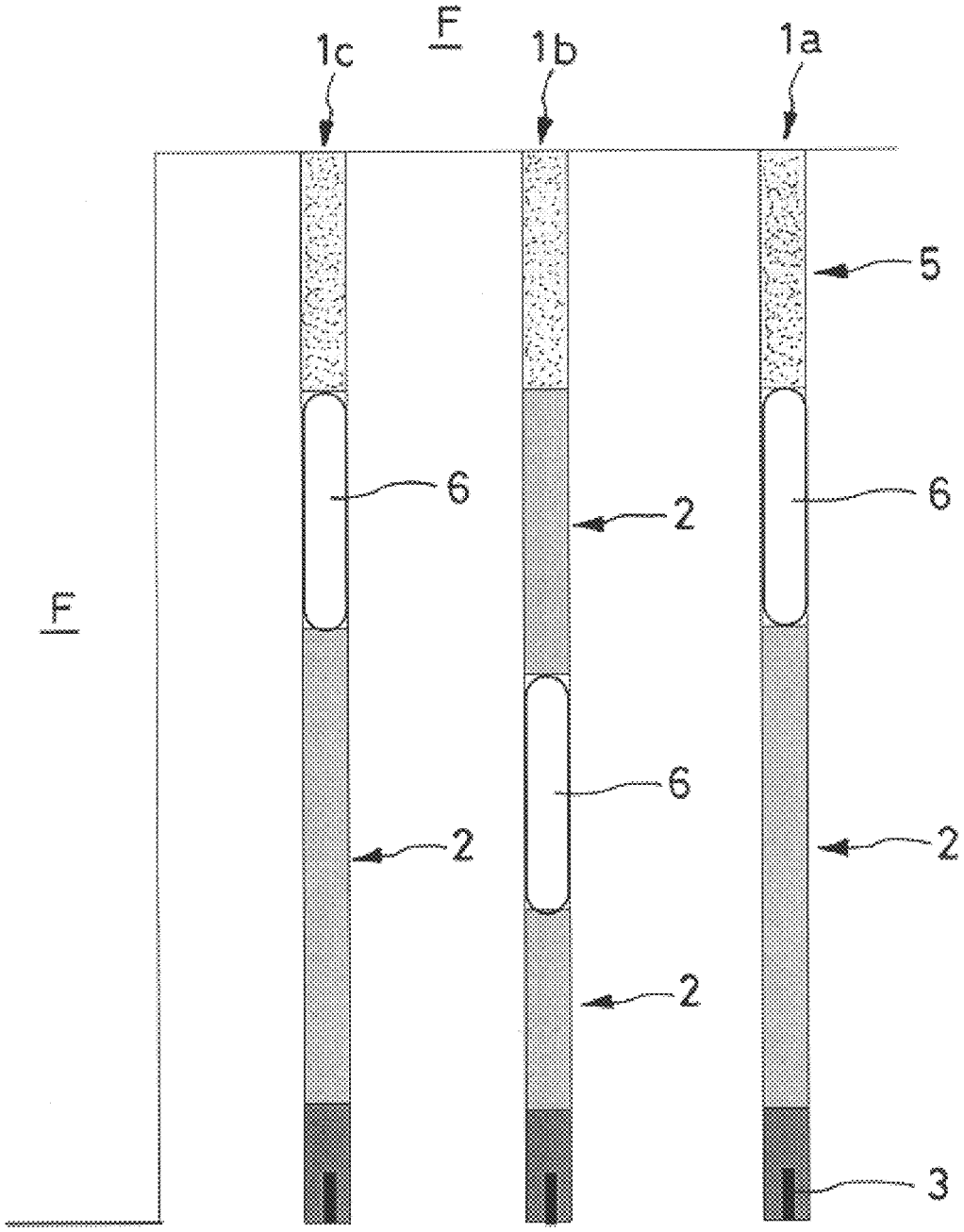

In FIG. 4H, boreholes 1 are charged with explosives 2 and air tubes 6 such that in adjacent two boreholes the air tubes 6 are located in cross relation between each other. In the first borehole 1 a, charged are explosives 2 and detonator 3 at the bottom of the borehole, and the air tube 6 above the top of the explosives 2 with the stemmings 5 installed above the top of the air tube 6. In the second borehole 1*b*, charged are a first explosive 2 and detonator 3 at the bottom of the borehole, and the air tube 6 above the first explosive 2 and then a second explosive 2 is charged above the air tube 6. The stemmings 5 are installed above the top explosives 2. The third borehole 1*c* is charged with the same configuration of the first borehole 1*a*. In this arrangement, the second explosive layer 2 of the second borehole 1*b* has the detonation projection area directing to lateral air tubes 6 positioned in the boreholes 1*a* and 1*c*.

Figure 5:
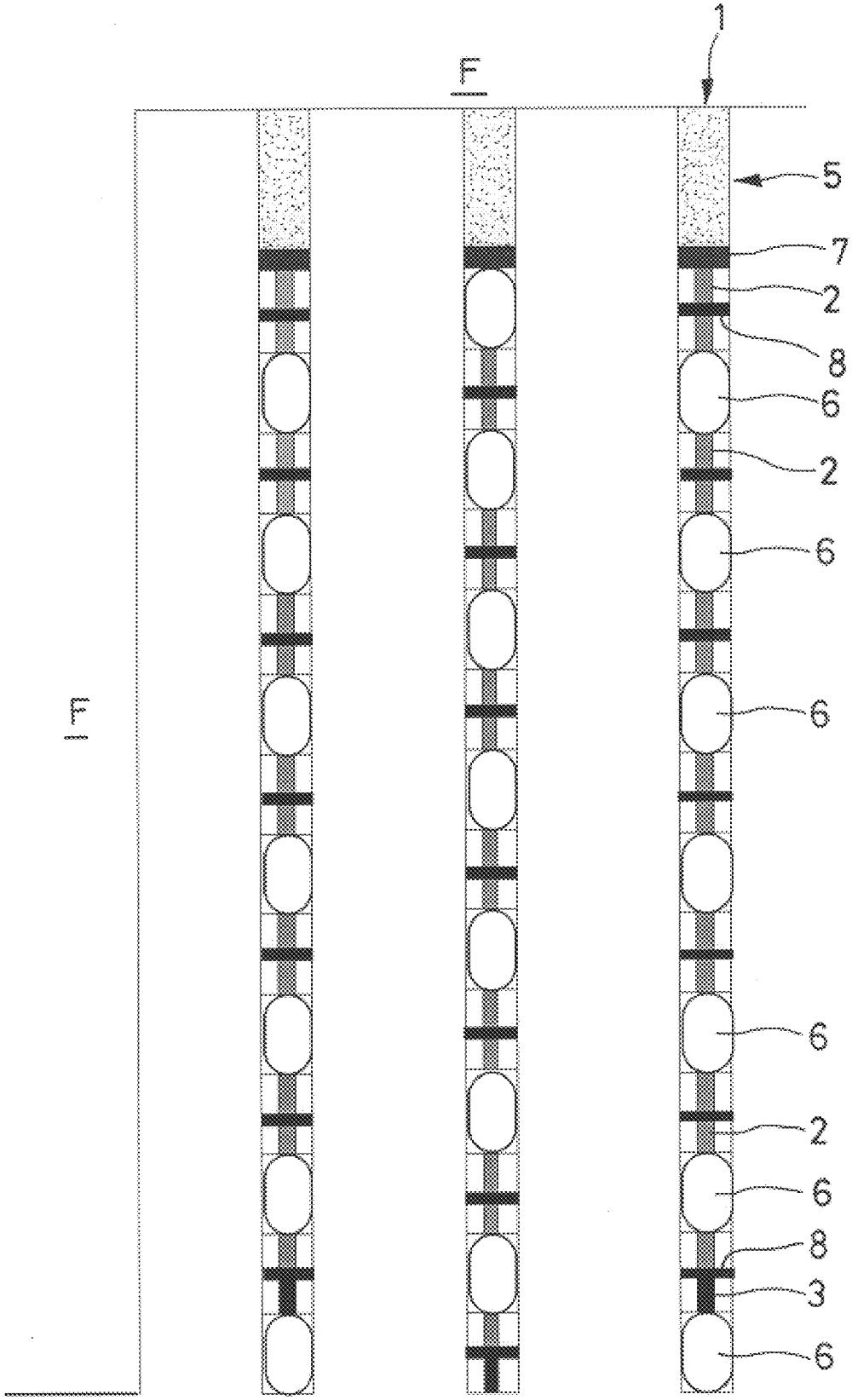
FIG. 5 shows a further embodiment of the present invention employing the air tube in the pre-splitting blast method.

FIG. 5 shows a further embodiment of the present invention which employs the air tube in the pre-splitting blast method. Generally, a series of boreholes 1 are charged alternately with air tubes 6 and explosives 2. Each explosive 2 is supported in the borehole by a ring shaped supporter or a spacer 8, in order to fix the explosive body parallel to the borehole wall. Only a detonator 3 is installed at the bottom portion of each borehole 1. Stemming 5 is installed above the top explosive and a rubber plug 7 may be installed below the stemming 5. In the embodiment of FIG. 5, the explosive 2 and air tube 6 have the same length. Further, air tubes 6 are charged first at the bottom of the boreholes 1. In particular, the air tubes 6 are located in adjacent two boreholes in cross relation between each other so that an air tube 6 may face lateral explosives 2 as similar to the arrangement shown in FIG. 4H.

This embodiment uses the sympathetic detonation with which explosive layers placed above the detonator 3 can be detonated in minute time delay sequence. This method avoids usage of a detonating fuse in every borehole required by the prior art pre-splitting blast. This also increases rock breaking efficiency with cost saving and a reduction in noise of the blast.

FIGS. 6A to 6D show still further embodiments of the present invention which install a rubber plug above the air tube. These embodiments employ the same principle of the invention in that the air tube may be charged at the bottom of the borehole, between two explosive layers, and at the top explosive layer of the borehole.

Figure 6A:
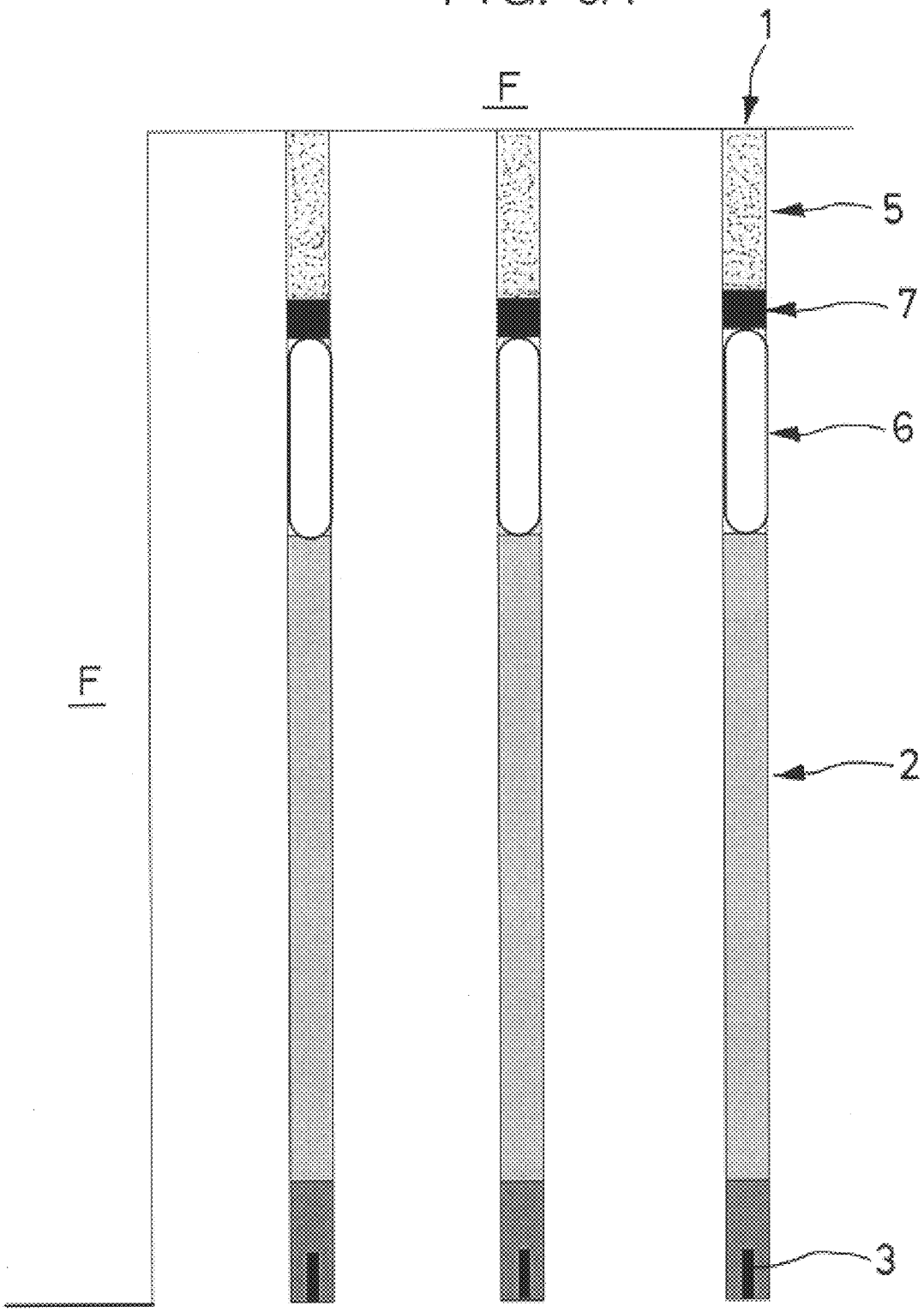
FIGS. 6A to 6D show still further embodiments of the present invention employing rubber plugs installed above the air tube charged in a borehole.

In FIG. 6A, boreholes 1 are charged with the explosives 2 and detonator 3 at the bottom of borehole, and air tubes 6 are charged above the top of the explosives 2. Subsequently, a rubber plug 7 is installed above the air tube 6 and then stemming material 5 is installed above the rubber plug 7.

Figure 6B:
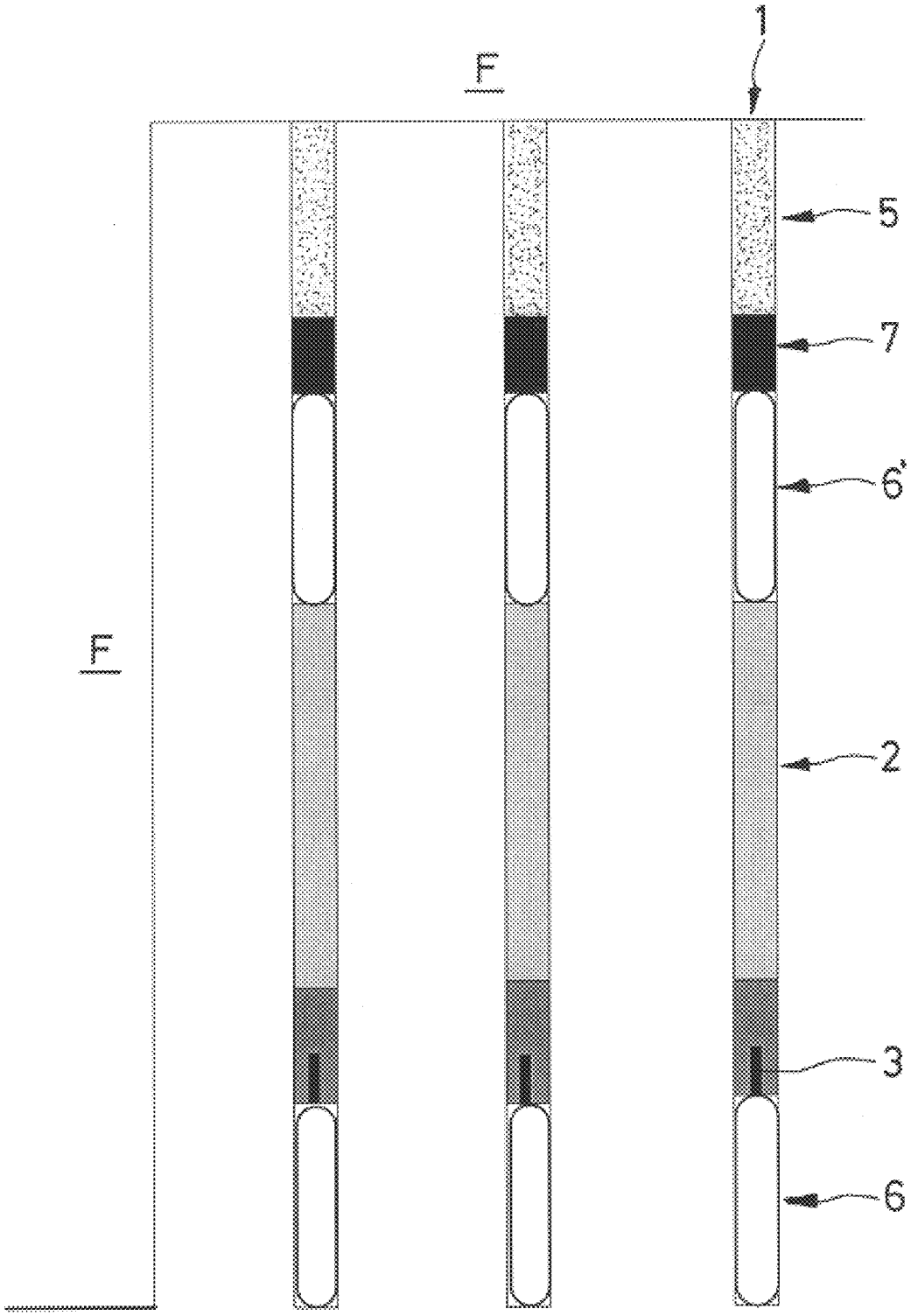

In FIG. 6B, boreholes 1 are charged first with air tubes 6 at the bottom of borehole and subsequently the explosives 2 and detonator 3 are charged above the air tube 6. A second air tube 6' is charged above the explosives 2. Rubber plugs 7 are installed above the second air tubes 6'. Finally, stemmings 5 are installed above the rubber plugs 7.

Figure 6C:
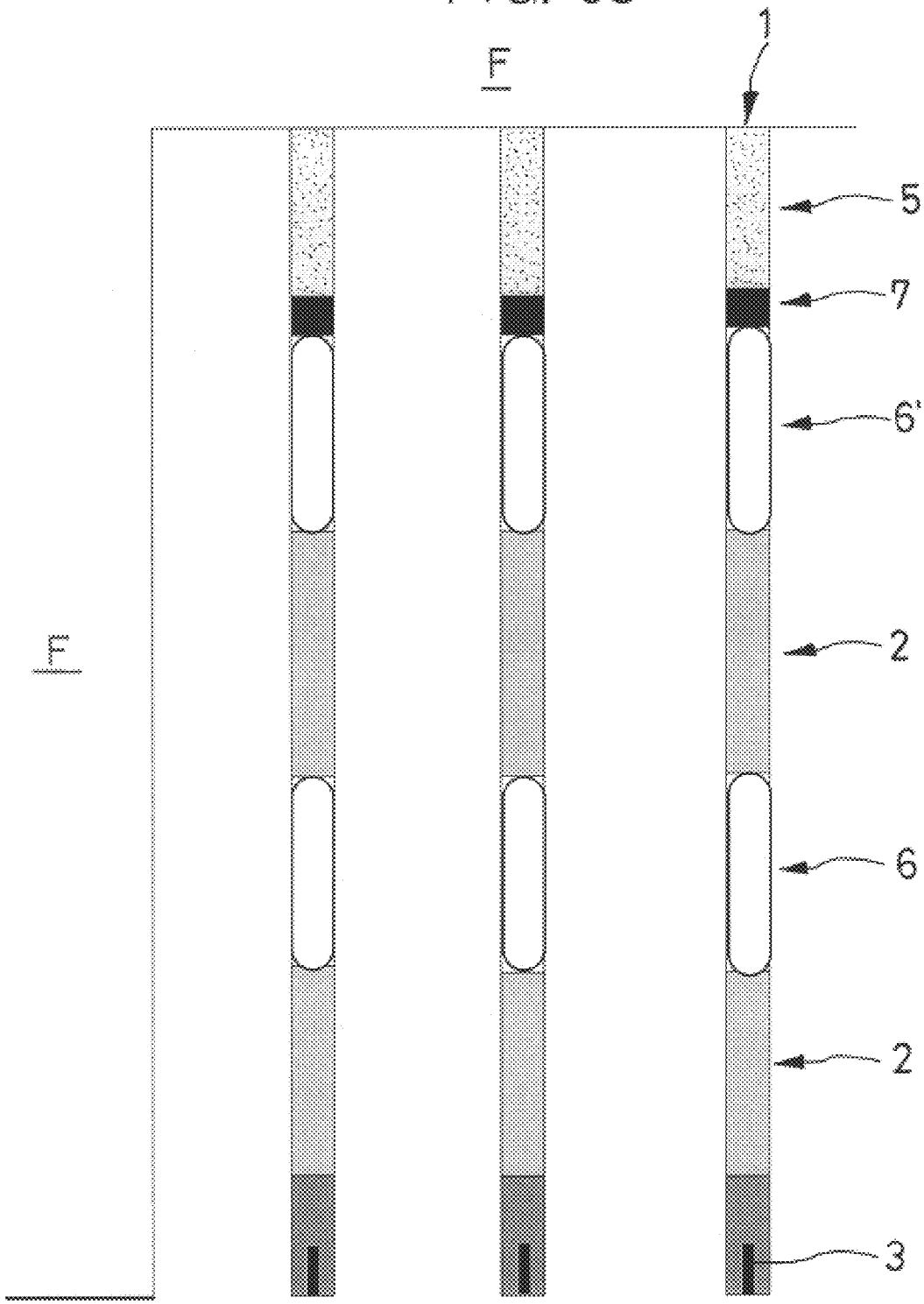

In FIG. 6C, boreholes 1 are charged with explosives 2 and detonator 3 at the bottom of the borehole. Subsequently, air tubes 6 are charged above the explosives 2 and then a second explosives 2 are charged above the air tube 6. Again, a second air tube 6' is charged above the second explosives 2 and then rubber plugs 7 are installed above the second air tubes 6'. Finally, stemmings 5 are installed above the rubber plugs 7.

Figure 6D:
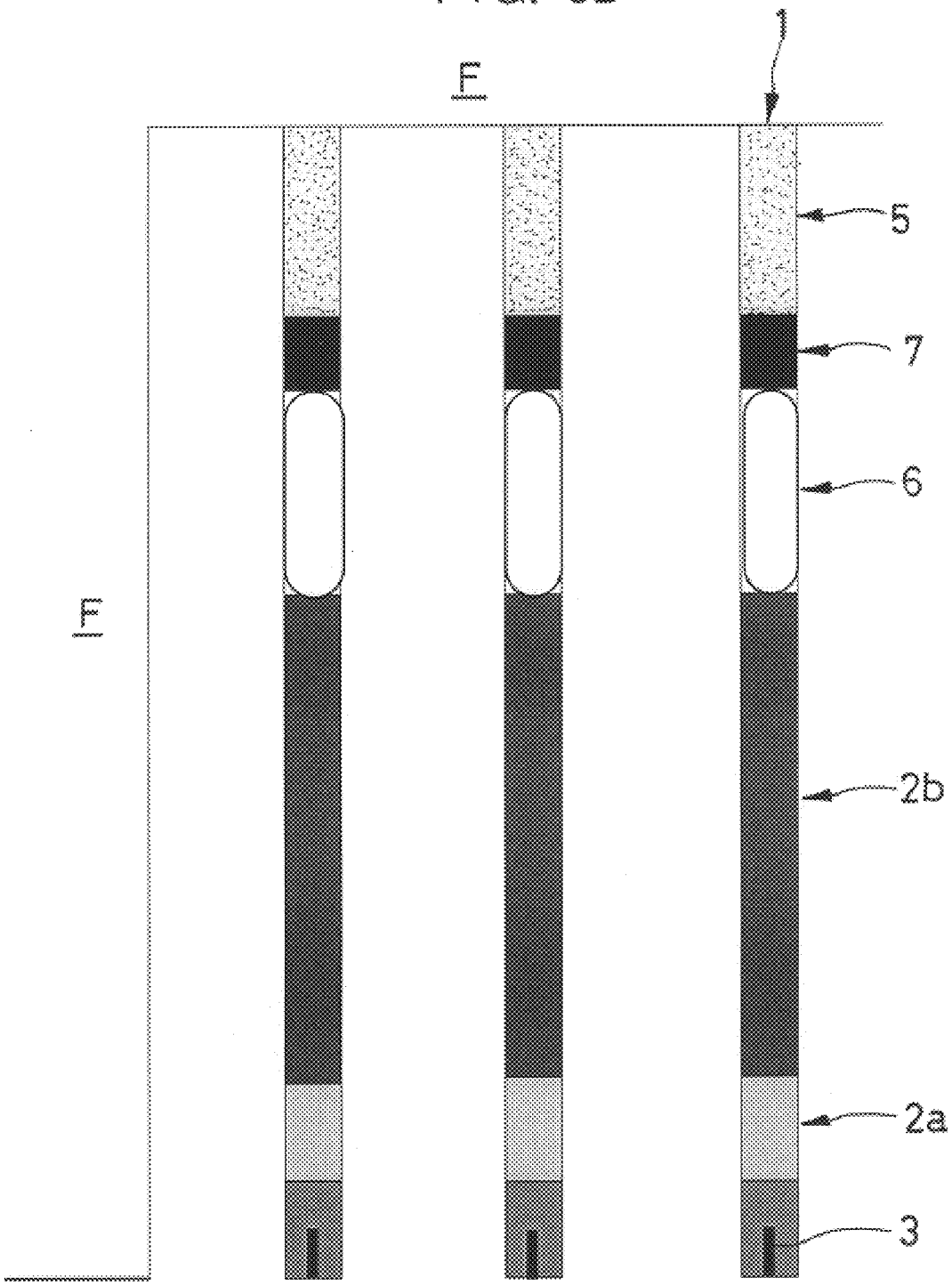

In FIG. 6D, boreholes 1 are charged with explosive cartridges 2*a* and detonator 3 at the bottom of the borehole, and subsequently with ANFO 2*b*. Above the ANFO explosives 2*b*, air tubes 6 are charged. Then, rubber plugs 7 are installed above the air tube 6 and stemmings 5 are installed above the rubber plugs 7.

This method would overcome the bit gauge drop effect that decreases the diameter of the borehole due to wear of the drilling bit. The different diameters of boreholes result in difficulties in regulating the amount of ANFO explosive and differentiate the length of stemmings. These can be compensated by adjusting the length of the air tube.

In the embodiments of FIG. 6A to 6D, the rubber plug 7 is installed between the stemmings 5 and the air tube 6. With this, noise of the blast can be considerably reduced.

Parting from the above embodiments, various modification can be made to the arrangement of the air tubes within the spirit and scope of this invention.

EXAMPLE 1

In a field example, the method of the invention was employed to reduce vibration and noise of blast in a bench. A series of boreholes, as shown in FIG. 4B, were drilled vertically downward to a depth of 2.5 meters into the rock body and each borehole was charged with the explosives 2 and detonator 3 with one air tube 6 installed above the explosives 2. The stemmings 5 was installed above the air tube 3. In the drilling pattern, the number of boreholes (at one shot) was 5, the diameter of borehole 45 millimeters, spacing between boreholes 1.2 meters, the minimum burden 1.0 meter. As to the charge pattern, the length of explosive charging was 0.8 meters, the co-operating charge weight was 0.648 Kg, the total amount of explosive 3.24 Kg, the length $l_3$ of air tube 1.0 meter, the diameter of air tube 40 millimeters, and the length of stemmings was 0.7 meters.

In a comparative example, common blasting method was employed in near bench. Boreholes were drilled with the same drilling pattern as the above example 1. While, the length of explosive charging was 0.8 meters (same as Example 1), the co-operating charge weight was 0.81 Kg and the total amount of explosive was increased to 4.05 Kg. The length of stemmings was 1.7 meters. The details of the above patterns are described in table 1.

In the above examples, the explosives were initiated by common blasting circuit and the same field test was performed repeatedly. The resulting vibration and noise of the blast in each explosion were measured at several spaced spots and in some different areas. Furthermore, the same or similar field test was performed repeatedly on other days. The results are described in tables 2–7 below.

EXAMPLE 2

In another field example, a series of boreholes, as shown in FIG. 4F, were drilled vertically downward to a depth of 6.0 meters into the rock body and each borehole was charged with two explosive layers 2 including a base charge and two air tubes 6, 6' were installed above each explosive layer 2. The stemmings 5 was installed above the air tube 3. In the drilling pattern, the number of boreholes (at one shot) was 10, the diameter of borehole 75 millimeters, the hole spacing 1.1 meters, the minimum burden 1.0 meter. In the charging pattern, the length of explosive charging was 3.0 meters, the co-operating charge weight was 4.75 Kg, the total amount of explosive 47.5 Kg, the length of air tubes 1.5 meters (upper 1.0 meter, lower 0.5 meters), the diameter of air tube 50 millimeters, and the length of stemmings was 1.5 meters.

As the comparative example, boreholes were drilled with the same drilling pattern as the above example 2. While, the length of explosive charging was 2.6 meters, the co-operating charge weight was 6.0 Kg, and the total amount of explosive was increased to 60 Kg. The length of stemmings was 3.4 meters. The details of the above patterns are described in table 1 along with the Example 1.

The explosives were initiated by common blasting circuit and the same field test was performed repeatedly. The resulting vibration of blast in each explosion was measured at several spaced spots. Additionally, a similar field test was performed repeatedly on other day. The results are described in tables 8 and 9 below.

TABLE 1

| | Number of Boreholes (at one shot) | Depth of Borehole (M) | Co-operating charge weight (Kg) | Total amount of Explosive charge (Kg) | Length of Explosive charge (M) | Length of Stemmings (M) | Diameter of Borehole (mm) | Minimum Burden (M) | Hole Spacing (M) | Length of Air Tubes (M) | Diameter of Air Tube (mm) |
|---|---|---|---|---|---|---|---|---|---|---|---|
| Example 1 | 5 | 2.5 | 0.648 | 3.24 | 0.8 | 0.7 | 45 | 1.0 | 1.2 | 1.0 | 40 |
| Example 2 | 10 | 6.0 | 4.75 | 47.5 | 3.0 | 1.5 | 75 | 1.0 | 1.1 | 1.5<br>Up.: 1.0<br>Lo.: 0.5 | 45 |
| Comp. Example 1 | 5 | 2.5 | 0.81 | 4.05 | 0.8 | 1.7 | 45 | 1.0 | 1.2 | — | — |
| Comp. Example 2 | 10 | 6.0 | 6.0 | 60.0 | 2.6 | 3.4 | 75 | 1.0 | 1.1 | — | — |

TABLE 2

Vibration/Noise measured in area A

Unit: cm/sec/dB(A)

| Distance ID. | 32 meters | 41 meters | 60 meters | 70 meters (A) | 70 meters (B) | 100 meters | Notes |
|---|---|---|---|---|---|---|---|
| Comp. Example 1 (1st.) | 1.80/93.8 | 1.101/89.1 | 0.291/85.5 | 1.473/78.5 | 0.586 | 0.108/69.3 | |
| Comp. Example 1 (2nd.) | 1.41/89.4 | 1.298/93.4 | 0.238/83.2 | 0.687/76.5 | N/A | 0.073/70.1 | |
| Example 1 (3rd.) | 1.88/93.4 | 1.036/81.1 | 0.135/83.2 | 0.927/77.1 | 0.365 | N/A/68.4 | FIG. 4B |
| Example 1 (4th.) | 1.17/90.2 | 0.976/79.6 | 0.394/80.2 | 0.648/75.1 | 0.648 | 0.097/67.8 | FIG. 4B |

TABLE 3

Vibration velocity measured in area B

Unit: cm/sec

| Distance ID. | 40 meters | 50 meters | 60 meters | 90 meters | Note 1 | Note 2 |
|---|---|---|---|---|---|---|
| Comp. Example 1 (1st.) | 1.43 | 0.884 | 0.687 | 0.0476 | — | Measured at underground structure of subway |
| Comp. Example 1 (2nd.) | 1.29 | 0.733 | 0.985 | 0.027 | — | |
| Example 1 (3rd.) | 1.08 | 0.578 | 0.768 | 0.036 | FIG. 6D | |
| Example 1 (4th.) | 0.416 | 0.313 | 0.587 | N/A | FIG. 6D | |

TABLE 4

Noise measured in area B

Unit: dB(A)

| Distance ID. | 50 meters | 60 meters | Note 1 | Note 2 | Note 3 |
|---|---|---|---|---|---|
| Comp. Example 1 (1st.) | 81.2 | 82.3 | — | Without Rubber Plug | Measured at underground structure of a subway |
| Comp. Example 1 (2nd.) | 82.6 | 82.1 | — | Without Rubber Plug | |
| Example 1 (3rd.) | 75.3 | 76.3 | FIG. 6D | With Rubber Plug | |
| Example 1 (4th.) | 74.3 | 75.7 | FIG. 6D | With Rubber Plug | |

TABLE 5

Vibration/Noise measured in area B on other day

Unit: cm/sec/dB(A)

| Distance ID. | 40 meters | 50 meters | 60 meters | Note 1 | Note 2 |
|---|---|---|---|---|---|
| Comp. Example 1 (1st.) | 0.721/93.8 | 0.675/— | 0.879/— | — | Measured at underground structure of a subway |
| Comp. Example 1 (2nd.) | 0.597/94.2 | 0.491/— | 0.786/— | — | |
| Comp. Example 1 (3rd.) | 0.572/93.8 | 0.489/— | 0.765/— | | |

TABLE 5-continued

Vibration/Noise measured in area B on other day

Unit: cm/sec/dB(A)

| Distance ID. | 40 meters | 50 meters | 60 meters | Note 1 | Note 2 |
|---|---|---|---|---|---|
| Comp. Example 1 (4th.) | 0.805/95.2 | 0.495/— | 0.769/— | | |
| Comp. Example 1 (5th.) | 1.250/96.6 | 0.521/— | 0.875/— | | |
| Example 1 (6th.) | 0.597/94.2 | 0.613/— | 0.658/— | FIG. 6D | |
| Example 1 (7th.) | 0.676/93.6 | 0.772/— | 0.698/— | FIG. 6D | |

TABLE 6

Vibration velocity measured in area C

Unit: cm/sec

| Distance ID. | 150 meters | 200 meters | 300 meters | Note |
|---|---|---|---|---|
| Comp. Example 1 (1st.) | 0.813 | 0.273 | 0.326 | — |
| Example 1 (2nd.) | 0.806 | 0.252 | 0.296 | FIG. 6D |

TABLE 7

Noise measured in area C

Unit: dB(A)

| Distance ID. | 150 meters | 200 meters | Note 1 | Note 2 |
|---|---|---|---|---|
| Comp. Example 1 (1st.) | 76.8 | 71.4 | — | No rubber plugs |
| Example 1 (2nd.) | 52.4 | 42.4 | FIG. 6D | Use rubber plugs |

TABLE 8

Vibration/Noise measured in area B

Unit: cm/sec/dB(A)

| Distance ID. | 30 meters (A) | 30 meters (B) | 30 meters (C) | 30 meters (D) | Note |
|---|---|---|---|---|---|
| Comp. Example 2 (1st.) | 0.194 | 0.202/73.0 | 0.324 | 0.879 | |
| Comp. Example 2 (2nd.) | 0.432 | 0.276/73.0 | 0.508 | 0.712 | |
| Example 2 (3rd.) | 0.287 | 0.318/72.8 | 0.384 | 0.426 | FIG. 4F |
| Example 2 (4th.) | 0.348 | 0.294/73.0 | 0.470 | 0.547 | FIG. 4F |

TABLE 9

Vibration/Noise measured in area B on other day

Unit: cm/sec/dB(A)

| Distance ID. | 30 meters (A) | 30 meters (B) | 30 meters (C) | 30 meters (D) | Note |
|---|---|---|---|---|---|
| Comp. Example 2 (1st.) | 0.429 | 0.401/73.0 | 0.365 | 0.879 | |
| Comp. Example 2 (2nd.) | 0.489 | 0.396/73.2 | 0.426 | 0.523 | |
| Comp. Example 2 (3rd.) | 0.398 | 0.368/72.8 | 0.401 | 0.426 | |
| Comp. Example 2 (4th.) | 0.523 | 0.396/72.8 | 0.395 | 0.687 | |
| Comp. Example 2 (5th.) | 0.463 | 0.324/73.0 | 0.423 | 0.547 | |
| Comp. Example 2 (6th.) | 0.398 | 0.360/72.6 | 0.452 | 0.684 | |
| Comp. Example 2 (7th.) | 0.369 | 0.321/72.6 | 0.532 | 0.532 | |

TABLE 9-continued

Vibration/Noise measured in area B on other day

Unit: cm/sec/dB(A)

| Distance ID. | 30 meters (A) | 30 meters (B) | 30 meters (C) | 30 meters (D) | Note |
|---|---|---|---|---|---|
| Example 2 (8th.) | 0.356 | 0.310/73.4 | 0.396 | 0.435 | FIG. 4G |
| Example 2 (9th.) | 0.342 | 0.303/72.1 | 0.369 | 0.469 | FIG. 4G |
| Example 2 (10th.) | 0.326 | 0.296/72.4 | 0.368 | 0.423 | FIG. 4G |

In the above exemplary field tests, the measurement of vibration velocity was carried out in three different areas A, B and C, according to the examples of different charging methods. The distance between the center of an explosion and the measurement spots varies from 30 meters to 300 meters. While the amount of explosive charge used in the example 1 and 2 was decreased about 20% as small as that of the common blasting method, the resulting vibration velocity measured in area A was in the range from 0.097 to 1.17 cm/sec indicating on the whole the decrease in vibration about 30–50% as compared to the common blasting method. In the tables, N/A indicates there was almost no vibration by which the measuring instrument could sense. Also, the difference in the result of measurement relative to repeated tests is considered that it is caused by conditions of free surfaces of the rock and properties thereof.

Referring to the tables 4 and 7, in the examples that use the rubber plug, the noise of blasting was found to be decreased about 5 to 10 dB as compared to those examples without the rubber plug. The use of the rubber plug is optional as a large scale blasting places such as aggregate collecting places and quarry faces may require use of no rubber plugs. However, in urban places the use of rubber plugs is desirable.

In brief, for a comparison purpose, the representative example and the results of the measurement can be summarized as the following table 10.

TABLE 10

| Properties | | Common Blast (Comp. Example 2) | Blasting with Air tubes (Example 2) |
|---|---|---|---|
| Drilling Pattern | | common spacing and minimum burden | the same |
| Blasting Condition | Nos. of Borehole | 10 | the same |
| | Co-operating charge weight | 6.0 Kg | 4.75 Kg (about 20% decreased) |
| | Specific charge | 0.9 Kg/m$^3$ | 0.71 Kg/m$^3$ (about 22% reduced) |
| | Length of Air tubes | None | 150 cm |
| | Nos. of detonator | At common blasting: 10<br>At deck charge: 20 | 10<br>At deck charge: 10 (10 reduced) |
| Measuring Distance | | 50–70 meters | the same |
| Results of the measurement | Vibration velocity | 1.473 cm/sec | 0.927 cm/sec (about 37% reduced) |
| | Noise of blasting | 75.3 dB/A | 70.2 dB/A (about 6% reduced) |
| | Breakage | Poor | Good |
| Amount of explosive used | | 60 Kg | 47.5 Kg (about 20% reduced) |

As apparent from the above table 10, the rock blasting method of the invention provides important improvements over earlier known blasting methods. The use of air tubes, charged above at least one explosive layer produces a vibration dispersion effect by which the detonation velocity is reduced considerably to achieve a vibration controlled blasting suitable to be adopted in urban blast sites.

In addition, the use of air tubes substantially produces a noise covering effect. The use of rubber plugs fitted above the air tube enhances the noise covering effect.

Further, the air tube increases the total pressure of detonating explosive by which the specific surface area is expanded toward free surfaces of the rock to achieve an increase in fragmentation rate or breakage of the rock with minimizing the production of boulders. A reduction in explosive usage is also achieved.

Compared to common deck charge blast, the invention requires a greatly reduced number of detonators. This would allow a significant cost saving and a reduction in produce of noise. The same effect would result in pre-splitting blast, since the invention avoids usage of a detonating fuse. The method of this invention is particularly well suited to large scale open blasting site and quarry operations.

Further, compared to the prior art air decking method, this invention avoids annoying plug installation operation in every borehole of large scale blast sites. In particular, according to the invention, the use of air tubes allows a quantitative air decking in every blasthole. Also, the use of air tubes provides an easy way for adjusting the air deck length of each blasthole according to properties of the rock.

While the invention has been described in terms of exemplary embodiments, it is contemplated that it may be practiced as outlined above with modifications within the spirit and scope of the appended claims.

What is claimed is:

1. An improved method of rock blasting with explosives comprising the steps of:

drilling a series of aligned boreholes in a rock body according to a desired drilling pattern;

charging said boreholes with explosives and an air tube in a predetermined pattern so as to provide a quantitative air decking in every charged borehole; and detonating said charged boreholes with stemmings on the top of the explosive or air tube.

2. A method as claimed in claim 1, wherein said air tube is a cylindrical flexible tube having a predetermined width and length to be fitted with said borehole.

3. The method as claimed in claim 2, wherein said air tube is provided with an air injection port at one end portion thereof.

4. The method as claimed in claim 2, wherein said air tube is made in the form of sheets and the diameter thereof, upon inflation, becomes the same as or smaller than that of said boreholes.

5. The method as claimed in claim 2, wherein said air tube and said air injection port are made from synthetic materials such as polyethylene, polypropylene, polyester and polyamide.

6. The method as claimed in claim 4, wherein said air tube is inflated by using an air injector of air compressors provided in work sites.

7. The method as claimed in claim 1, wherein said explosives and said air tube are alternately charged along said borehole.

8. The method as claimed in claim 7, wherein said air tube is charged first at the bottom of said borehole and subsequently a detonator is charged above said air tube.

9. The method as claimed in claim 7, wherein said air tube is installed above the top of said explosives by which the length of stemming charged above said air tube is reduced as much as the extent of said air tube.

10. The method as claimed in claim 9, wherein a plug is installed above the top of said air tube charged in the borehole.

11. The method as claimed in claim 7, wherein said explosives and air tube are charged in adjacent two boreholes such that they are located in cross relation between each other so that one air tube may face lateral explosives in adjacent boreholes.

12. The method as claimed in claim 7, wherein said explosives charged above said air tube is detonated by sympathetic detonation.

13. The method as claimed in claim 3, wherein said air tube is made in the form of sheets and the diameter thereof, upon inflation, becomes the same as or smaller than that of said boreholes.

14. The method as claimed in claim 3, wherein said air tube and said air injection port are made from synthetic materials such as polyethylene, polypropylene, polyester and polyamide.

15. The method as claimed in claim 13, wherein said air tube is inflated by using an air injector of air compressors provided in work sites.

* * * * *